US010633726B2

(12) United States Patent
Chinella

(10) Patent No.: US 10,633,726 B2
(45) Date of Patent: Apr. 28, 2020

(54) METHODS, COMPOSITIONS AND STRUCTURES FOR ADVANCED DESIGN LOW ALLOY NITROGEN STEELS

(71) Applicant: U.S. Army Research Laboratory ATTN: RDRL-LOC-I, Adelphi, MD (US)

(72) Inventor: John F. Chinella, Warwick, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 154 days.

(21) Appl. No.: 15/678,573

(22) Filed: Aug. 16, 2017

(65) Prior Publication Data

US 2019/0055632 A1 Feb. 21, 2019

(51) Int. Cl.
*C22C 38/00* (2006.01)
*C22C 38/02* (2006.01)
(Continued)

(52) U.S. Cl.
CPC ..... *C22C 38/001* (2013.01); *C21D 8/0263* (2013.01); *C22C 38/04* (2013.01);
(Continued)

(58) Field of Classification Search
CPC ..... C22C 38/001; C22C 38/02; C22C 38/04; C22C 38/06; C22C 38/08; C22C 38/10; C22C 38/105; C22C 38/12; C22C 38/14; C22C 38/16; C22C 38/18; C22C 38/20; C22C 38/22; C22C 38/24; C22C 38/26; C22C 38/28; C22C 38/30; C22C 38/40;
(Continued)

(56) References Cited

U.S. PATENT DOCUMENTS 4,284,439 A * 8/1981 Gemmel ..... C21D 6/002 148/325
4,878,955 A * 11/1989 Hoshino ..... C22C 38/001 148/610

(Continued)

OTHER PUBLICATIONS

Dr. Lueg, Vereinigte Schmiedewerke GmbH (VSG), as a result of Mr. Chinella's communication, sent to Mr. Chinella marketing literature Apr. 6, 1993 on high alloy austenitic and martensitic HNS and "heat treatable 3.5Ni, steels" including a VSG company marketing pamphlet publication, (Druckschrift 7 12 89 e5), "Nitrogen alloying under pressure, a new high-pressure process with a technical edge reaching beyond 2000."

(Continued)

*Primary Examiner* — Cam N. Nguyen
(74) *Attorney, Agent, or Firm* — Christos S. Kyriakou

(57) ABSTRACT

A low alloy high nitrogen steel includes iron and, by weight 0.14-0.60% nitrogen (N); 0.08-0.28% carbon (C); 0.10-2.20% nickel (Ni); 0.25-2.00% manganese (Mn); 1.20-2.70% chromium (Cr); 0.45-1.50% tungsten (W); not more than 0.05% molybdenum (Mo); not more than 0.02% vanadium (V); not more than 0.60% silicon (Si); not more than 0.10% copper (Cu); not more than 0.02% titanium (Ti); not more than 0.02% niobium (Nb); not more than 0.008% aluminum (Al); and not more than 0.02% of any other element with not more than 0.10% total other elements, wherein cobalt (Co) is substitutable for any part of the nickel.

20 Claims, 15 Drawing Sheets

(51) Int. Cl.

| | |
|---|---|
| ***C22C 38/04*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/30*** | (2006.01) |
| ***C22C 38/40*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C21D 8/02*** | (2006.01) |

(52) U.S. Cl.
CPC ..... *C22C 38/30* (2013.01); *C22C 38/44* (2013.01); *C21D 2211/008* (2013.01)

(58) Field of Classification Search
CPC ..... C22C 38/42; C22C 38/44; C22C 38/46; C22C 38/48; C22C 38/50; C22C 38/52; C21D 8/0263
See application file for complete search history.

(56) References Cited

U.S. PATENT DOCUMENTS

| | | | | |
|---|---|---|---|---|
| 5,008,072 | A * | 4/1991 | Siga | C22C 38/44 148/325 |
| 5,718,776 | A * | 2/1998 | Yoshie | B23K 35/3053 148/320 |
| 5,792,285 | A * | 8/1998 | Miyazaki | C22C 38/26 148/325 |
| 6,514,359 | B2 * | 2/2003 | Kawano | C22C 38/22 148/328 |
| 6,673,165 | B2 * | 1/2004 | Koga | C22C 38/001 148/325 |
| 6,706,419 | B2 * | 3/2004 | Yoshinaga | C21D 8/0226 148/320 |
| 7,531,129 | B2 * | 5/2009 | Igarashi | C22C 38/58 138/142 |
| 7,537,727 | B2 | 5/2009 | Dilmore et al. | |
| 7,678,207 | B2 * | 3/2010 | Omori | C21D 1/10 148/567 |
| 7,686,896 | B2 * | 3/2010 | Yoshida | C22C 38/02 148/320 |
| 8,076,008 | B2 * | 12/2011 | Kaneko | C22C 38/001 428/659 |
| 8,153,055 | B2 * | 4/2012 | Nakamura | C22C 38/001 420/60 |
| 8,313,589 | B2 * | 11/2012 | Takasawa | C21D 1/28 148/330 |
| 8,845,825 | B2 * | 9/2014 | Hashimura | C21D 9/52 148/206 |
| 8,864,920 | B2 * | 10/2014 | Yamasaki | C21D 8/065 148/505 |
| 9,150,947 | B2 * | 10/2015 | Nishiyama | C22C 38/001 |
| 9,212,410 | B2 * | 12/2015 | Yamasaki | C21D 8/065 |
| 9,255,306 | B2 * | 2/2016 | Yamasaki | C21D 8/08 |
| 9,279,172 | B2 * | 3/2016 | Kato | C22C 38/06 |
| 9,303,295 | B2 * | 4/2016 | Hackett | C21D 6/02 |
| 9,453,269 | B2 * | 9/2016 | Yokoi | C22C 38/28 |
| 9,458,520 | B2 * | 10/2016 | Toda | C23C 2/40 |
| 9,493,855 | B2 * | 11/2016 | Branagan | C21D 8/005 |
| 9,512,508 | B2 * | 12/2016 | Shuto | C22C 38/001 |
| 9,540,718 | B2 * | 1/2017 | Ishida | C22C 38/00 |
| 9,587,319 | B2 * | 3/2017 | Fujita | C21D 8/0226 |
| 9,631,265 | B2 * | 4/2017 | Sano | C21D 8/0236 |
| 9,657,382 | B2 * | 5/2017 | Funakawa | C22C 38/001 |
| 9,670,569 | B2 * | 6/2017 | Nozaki | C21D 8/0226 |
| 9,752,217 | B2 * | 9/2017 | Yokoi | C21D 8/0226 |
| 9,797,024 | B2 * | 10/2017 | Yokoi | C22C 38/28 |
| 9,841,124 | B2 * | 12/2017 | Toyoda | B21C 37/08 |
| 9,863,026 | B2 * | 1/2018 | Yokoi | C21D 8/0205 |
| 9,945,016 | B2 * | 4/2018 | Inoue | C22C 38/001 |
| 9,988,697 | B2 * | 6/2018 | Suwa | C22C 38/001 |
| 10,060,006 | B2 * | 8/2018 | Suwa | C22C 38/001 |
| 10,066,283 | B2 * | 9/2018 | Toda | C23C 2/02 |
| 10,151,010 | B2 * | 12/2018 | Koyama | C21D 9/32 |
| 10,161,524 | B2 * | 12/2018 | Kumano | F16J 15/0818 |
| 10,329,637 | B2 * | 6/2019 | Yokoi | C22C 38/30 |
| 10,358,689 | B2 * | 7/2019 | Hamada | C21D 9/46 |
| 2019/0055633 | A1 | 2/2019 | Chinella | |

OTHER PUBLICATIONS

V. G. Gavriljuk and H. Berns; High Nitrogen Steels, Structure, Properties, Manufacture, Applications; Springer, Berlin/Heidelburg, Germany 1999.

V.G. Gavriljuk, B.D. Shanina, H. Berns; A physical concept for alloying steels with carbon + nitrogen; Materials Science and Engineering A 481-482 (2008) 707-712.

R. Ritzenhoff., V Diehl, A. Hahn; Steel Grips Products and Quality. 2010, pp. 257-261.

G. Stein; pp. 247-249 in Steel Forgings, ASTM Special publication 903.

H. Berns, V. Gavriljuk; Tempering of Martensitic Stainless Steel with 0.6 w/o Nitrogen and / or Carbon. Journal de Physique IV, 1997, 07 (C5), pp. C5-263-C5-268.

Jacques Foct; Unexplored Possibilities of Nitrogen Alloying of Steel. in Advanced High Strength Low Alloy Steels; eds. Y. Weng, Y. Gan, H. Dong; Springer, New York, p. 363, 2011.

Anatoly G. Svyazhin, Jerzy Siwka, and Ludmila M. Kaputkina; High-Nitrogen Steels: The Current State and Development Trends. in Advanced High Strength Low Alloy Steels; eds. Y. Weng, Y. Gan, H. Dong; Springer, New York, p. 367, 2011.

O.A. Bannykh, V. M. Blinov, and M.V. Kostina; Structure and Properties of Low-Alloy High-Nitrogen Martensitic Steels, in Structural Steels, Metal Science and Heat Treatment. vol. 45, Nos. 1-2, 2003 (Translated from Metallovedenie i Termicheskaya Obrabotka Metallov, No. 2, pp. 3-8, Feb. 2003).

P. Pant, P. Dahlman, W. Schlump, and G. Stein; A new nitrogen alloying technique—a way to distinctly improve the properties of austenitic steel. Materials Technology, Steel Research 58 (1987) No. 1, pp. 18-25.

Innovations in Ultrahigh-Strength Steel Technology, Proceedings of the 34th Sagamore Conference, Aug. 30-Sep. 3, 1987, Lake George, NY.; G.B. Olson, M.A. Azrin, E.S. Wright eds.

Chinella, J. F. V50 Ballistic Protection, and Material Properties of 7020 Aluminum; ARL-TR-6148; U.S. Army Research Laboratory: Aberdeen Proving Ground, MD, Sep. 2012.

Thermo-Calc Software AB "Thermo-Calc v4.0" and "TCFE7-TCS Steels/Fe-Alloys Database, version 7.0", www.thermocalc.com , Stockholm, Sweden.

Ashby, M. F.; Gelles, S. H.; Tanner, L. E. The Stress at Which Dislocations Are Generated at a Particle-Matrix Interface. Philos. Mag. 1969, 19, 757.

* cited by examiner

METHODS, COMPOSITIONS AND STRUCTURES FOR ADVANCED DESIGN LOW ALLOY NITROGEN STEELS

GOVERNMENT INTEREST

The embodiments herein may be manufactured, used, and/or licensed by or for the United States Government without the payment of royalties thereon.

BACKGROUND

Technical Field

The embodiments herein generally relate to low alloy high nitrogen steels and methods of making the same, and more particularly to a high strength low alloy high nitrogen martensitic steel and methods of making the same.

Description of the Related Art

Conventional low alloy carbon steels (CS), and high to ultra-high strength low alloy martensitic steels, for example, alloy 4340 and alloy D6A6, are alloys of iron (Fe) and carbon (C) typically with nickel (Ni) and manganese (Mn), and solutes chromium (Cr) and molybdenum (Mo). A desired strength level of the high strength steels may be obtained by processing to a martensite structure by austenitizing solution treatment followed by quench and tempering. The strength of these martensitic steels is obtained by an effect of interstitial carbon effecting a long range non-symmetrical distortion of the steel microstructure, microstructure refinement by martensite and dislocations, and from tempering, which toughens and which may add further strengthening by transforming the quenched martensite into ferrite and fine carbides. To achieve the highest strength levels, these carbon steels require a process temper at low temperature, for example 205° C. from which issues can arise, for example, low toughness and low resistance to stress corrosion cracking. Furthermore, to achieve beneficial toughness properties with carbon steel there is a disadvantage of a concomitant loss in strength and hardness with increasing temper temperatures, for example at 800° F. to 900° F. or 427° C. to 482° C. Furthermore, the temper process of carbon steels occurs in part with the rejection of carbon from martensite and the covalent interatomic bonding of C which strongly clusters C with solute elements; e.g., Fe, Cr, and Mo, in the form of carbide structures. Tempered martensite embrittlement may contribute to significant lessening of toughness following temper processes carried out at 200-500° C. The tempered martensite embrittlement follows from effects of carbide morphology formed from thin layers of retained austenite and segregation of minor elements to austenite grain boundaries, especially phosphorous (P). For example, with reheat or tempering, low alloy carbon steels have a tendency to cluster C with solutes to form cementite $Fe_3C$, elemental C as graphite, and higher carbides $M_7C_3$ and $M_{23}C_6$, which coarsen in size with time at elevated temperatures. The $Fe_3C$ carbide is especially deleterious as it forms with chemical bond enthalpy of low strength. It follows that the alloy may have low strength and toughness due to fracture that may readily initiate around large carbide particles under tension and shear loads by initiation of microcracks and microvoids and their growth and coalescence. In compression loading, elastic incompatibilities of the matrix and carbides localize deformation which again may lead to localized initiation of fracture. At combined elevated temperatures and pressure; e.g., 250° C. to 600° C., the carbides in carbon steel lose strength with respect to the matrix which may lead to fracture, initiated by softening of the alloy during plastic flow or dynamic loading.

One technical solution to the problem of weak deleterious carbides in steel and the loss of strength during tempering has been the development of the high alloy secondary hardening steels; e.g., alloy AF1410, such as alloy AF1410 steel with 14Co-10Ni-2Cr-1Mo-0.16C, and Aermet 100 alloy. During tempering around 500° C., the coarse dispersed cementite in alloy AF1410 and these SHS may be dissolved and replaced with a finer, more dispersed, strongly bonded $M_2C$ carbide precipitate which can provide hardening and more resistance to decohesion, thereby maintaining toughness with strength. Another high alloy secondary hardening steel is HP 9-4-30, with 4.50Co-7.50Ni-1.0Mo-1.0Cr-0.30Mn-0.30C. A disadvantage of the high alloy secondary hardening steels is the high level of alloying elements increases the raw material costs for high alloy secondary hardening steels.

High nitrogen steels now commercially available are made by cast ingot metallurgy, for example stainless steels Energietechnik alloys Cronidur 30, P900, Carpenter's 15-15HS, or Outokumpu 2507 and 2205 duplex steels, have high alloy contents greater than 8 weight percent of Cr, Mn, Ni, and Mo so as to dissolve nitrogen in liquid and retain during solidification. Disadvantages of the austenitic and duplex HNS with high levels of Cr, Ni, Mo, or Mn along with C and N are equilibrium phases of carbides and nitrides that form upon reheat and which are detrimental to mechanical and corrosion properties. Furthermore, there is higher cost of alloy elements for higher levels of alloy content. The duplex and austenitic grades of HNS have disadvantages of lower levels of strength than martensitic steel. The pressurized electroslag remelt (PESR) ingot cast high alloy martensitic Cronidur 30 HNS has the disadvantage of a high Cr, Mo, C, and N contents which upon heating at extended periods have the tendency to form deleterious weak $M_{23}C_6$ and sigma phases which may be detrimental to corrosion resistance and toughness.

The claims embodied herein are not meant as a panacea for poor steelmaking practice which may encompass issues of composition, impurity levels, and the making, shaping, and heat treatment of low alloy steel. Nevertheless, the claims provide methods and compositions which may mitigate issues and provide new methods, compositions and improvements not otherwise available for low alloy steel.

The above information disclosed in this Background section is only for enhancement of understanding of the background of the disclosure and therefore it may contain information that does not form any part of the prior art nor what the prior art may suggest to a person of ordinary skill in the art.

SUMMARY

In view of the abovementioned, an embodiment herein provides a low alloy high nitrogen steel comprising iron and, by weight 0.14-0.60% nitrogen (N); 0.08-0.28% carbon (C); 0.10-2.20% nickel (Ni); 0.25-2.00% manganese (Mn); 1.20-2.70% chromium (Cr); 0.45-1.50% tungsten (W); not more than 0.05% molybdenum (Mo); not more than 0.02% vanadium (V); not more than 0.60% silicon (Si); not more than 0.10% copper (Cu); not more than 0.02% titanium (Ti); not more than 0.02% niobium (Nb); not more than 0.008% aluminum (Al); and not more than 0.02% of any other element with not more than 0.10% total other elements, wherein cobalt (Co) is substitutable for any part of the nickel. The steel may further comprise, by weight not more than 0.008% sulfur; not more than 0.015% phosphorus; not more than 40 ppm oxygen; not more than 4 ppm hydrogen; not more than 0.005% antimony; and not more than 0.005% tin; and not more than 0.005% arsenic. The steel may comprise a microstructure comprising tempered martensite or bainite.

The steel may further comprise, by weight 0.14-0.20% nitrogen; 0.14-0.18% carbon; 1.00-1.80% nickel; 1.00-1.70% manganese; 1.30-1.70% chromium; and 0.45-0.90% tungsten. The steel of claim 1, may further comprise, by weight 0.16-0.21% nitrogen; 0.16-0.20% carbon; 0.60-2.20% nickel; 0.50-2.00% manganese; 1.30-1.85% chromium; and 0.45-0.90% tungsten. The steel may further comprise, by weight 0.18-0.22% nitrogen; 0.18-0.22% carbon; 0.60-1.70% nickel; 0.50-2.00% manganese; 1.50-1.90% chromium; and 0.45-1.30% tungsten. The steel may further comprise, by weight 0.24-0.60% nitrogen; 0.08-0.28% carbon; 0.10-1.00% nickel; 0.25-1.00% manganese; 1.20-2.70% chromium; and 0.45-1.50% tungsten. The steel at gas pressure of 40 bar (40 MPa) or greater, upon transition through casting solidification and cooling, may comprise, partially by weight up to 0.008% gas; and up to 28% delta ferrite.

Another embodiment provides a method of making a low alloy high nitrogen steel structure, the method comprising providing a steel composition under a first gas atmosphere of 1 bar to 40 bars pressure or more by casting liquid to solid either as an ingot or direct to shape, or as rapidly solidified powder or granules, or providing a composition by solid state processing, then for ingot or optional processing hot working or forming said steel composition to form to a shape, heating said steel composition to normalize or austenitize, quenching said steel composition at a rate to produce a substantially martensitic or bainitic microstructure, and heating tempering said steel composition under a second gas atmosphere, wherein said second gas atmosphere comprises air, controlled atmosphere, or inert nitrogen or nitrogen and argon. The method of making may include additive manufacture by direct laser sinter welding of powder or granules to form a shape. The steel composition comprising iron and, by weight 0.14-0.60% nitrogen (N), 0.08-0.28% carbon (C), 0.10-2.20% nickel (Ni), 0.25-2.00% manganese (Mn), 1.20-2.70% chromium (Cr), 0.45-1.50% tungsten (W), not more than 0.05% molybdenum (Mo), not more than 0.02% vanadium (V), not more than 0.60% silicon (Si), not more than 0.10% copper (Cu), not more than 0.02% titanium (Ti), not more than 0.02% niobium (Nb), not more than 0.008% aluminum (Al), and not more than 0.02% of any other element with not more than 0.10% total other elements, wherein cobalt (Co) is substitutable for any part of the nickel; quenching the steel composition at a rate to produce a martensitic microstructure; and tempering the steel composition under a second gas atmosphere, wherein the second gas atmosphere comprises inert nitrogen or nitrogen and argon.

In the method, the heating austenitizing may further comprise heating and holding said steel composition to a temperature in a range of about 890° C. to about 950° C. In the method, the quenching may include at least one of: quenching into oil held at a temperature in a range of about 38° C. to about 177° C.; quenching into a solution of polymer and water held at a temperature in a range of about 27° C. to about 66° C.; quenching into a controlled stream of air or inert gas; applying a cryogenic treatment to a temperature in a range from about −78.5° C. to about −20° C.; and quenching into media at an intermediate temperature in a range from about 460° C. to about 650° C., holding for a predetermined time to harden the steel composition, followed by secondary quenching to a lower temperature.

In the method, the heating tempering may include at least one of: a single tempering step; multiple tempering steps including at least one chilling between tempering steps; multiple tempering steps without chilling between tempering steps; austempering, including intermediate quenching to a temperature in a range from about 440° C. to about 550° C. and holding prior to the quenching; and the quenching proceeding after a thermal mechanical treatment at a temperature in a range from about 860° C. to about 1000° C. In the method, the tempering may include at least one of a primary hardening at a temperature in a range from about 200° C. to about 440° C., or a secondary hardening at a temperature in a range from about 440° C. to about 550° C. or more.

The method may further include hot working by rolling, forging or extrusion of the steel composition at a temperature in a range from about 1000° C. to about 1190° C. to a predetermined structure shape, wherein the hot working may include either increments or single steps of heating and reduction. Composition levels of alloy elements may be adjusted to best meet hardenability requirements for specific shape thickness. The method may further include performing heat treatments of a softening anneal process following the hot working, and following any softening anneal with an optional heat treatment including normalizing the steel composition at a temperature in a range from about 870° C. to about 1020° C., followed by air cooling. The method may further include, prior to hot work, homogenizing the steel composition at a temperature in a heating range from about 870° C. to 1121° C.

After hot work shaping and softening annealing, the method may include performing at least one of mechanical cutting, machining, flame cutting, plasma cutting, grinding, and sanding a finish dimension or surface of the low alloy high nitrogen steel structure.

The method may further include first performing a solid state process of alloying, either by mechanical alloying of powder materials under a controlled atmosphere, any of N and hydrogen gas, N plus Ar gas, or N with ammonia, or either first performing under N or with a controlled atmosphere of N with ammonia to perform diffusion of N gas into solid surfaces, powders, or thin sheet materials, wherein following mechanical alloying, or a gas-solid diffusion N alloyed of powder or thin sheets, or a surface treatment, is manufactured and following by consolidation brought to a final structure by any combinations of cleaning, surface finishing, cold isostatic pressing, hot isostatic pressing, sintering, additive manufacture laser sinter-welding of powder, hot work, austenitization, quench, or temper processing at or greater than atmospheric pressure.

The method may further include using hot isostatic pressure to obtain the final structure by packing and sealing a powder or thin sheets in a container under nitrogen gas, then performing any combination of (i) remotely pressurizing the container to provide specific N pressure and mass so as to equal the argon pressure level of the surrounding hot isostatic press and then heating the hot isostatic press to diffuse the mass of N to complete finished composition solid powder or thin sheets; or (ii) performing vacuum evacuation of the container of finished composition powder or thin sheets to remove gas, cold isostatic pressing to remove bulk, then fully consolidating by hot isostatic pressing (HIP) at approximately 1000 to 1500 bars and at about temperatures of 1090° C. to 1250° C., following with an optional treatment of the hot work.

The method may further include obtaining the final structure by cold isostatic press consolidation of powder or thin sheet material of finished or near finished composition in nitrogen gas or controlled atmosphere in any of a sealed container or a shaped mold and then hot sintering or pressing at temperatures of approximately 1150° C. to 1400° C. under controlled atmosphere or N or N plus Ar at pressures of approximately 120 bars up to 250 bars followed by optional consolidation and shaping by hot extrusion or hot rolling at temperatures of approximately 1070° C. to 1300° C.

The method may further include obtaining the final structure by packing and sealing powder or thin sheet material of finished composition in a container under nitrogen gas or controlled atmosphere, evacuating the container to remove gas, cold isostatic pressing the container to remove bulk and then full consolidation by hot extrusion or hot rolling container at temperatures of approximately 1070° C. to 1300° C.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1B:
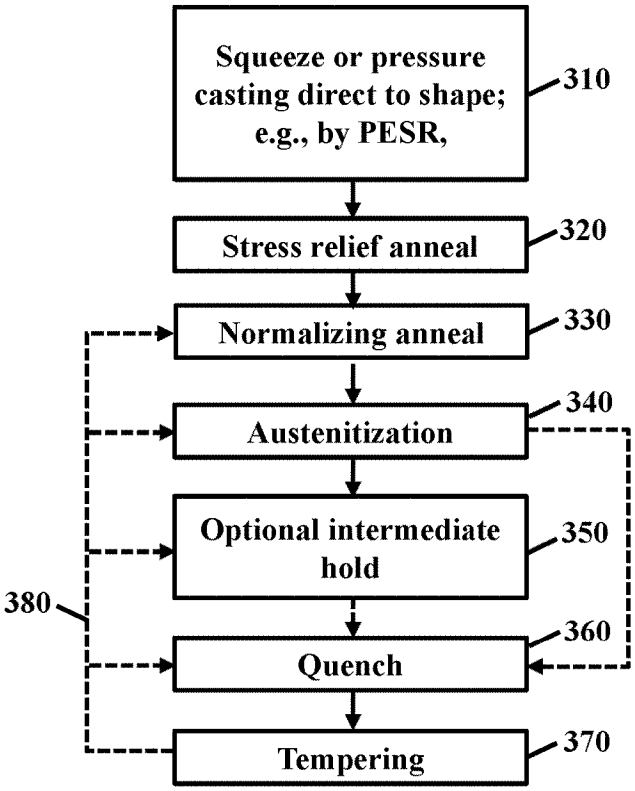
FIG. 1B is a flow diagram illustrating a cast to shape method of making a low alloy high nitrogen steel according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

It will be understood that when an element or layer is referred to as being "on", "connected to", or "coupled to" another element or layer, it can be directly on, directly connected to, or directly coupled to the other element or layer, or intervening elements or layers may be present. In contrast, when an element or layer is referred to as being "directly on", "directly connected to", or "directly coupled to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

In the drawings, the size and relative sizes of layers and regions may be exaggerated for clarity. Referring now to the drawings FIGS. 1A through 11B there are shown exemplary embodiments, whereby the similar reference characters denote corresponding features consistently throughout the figures.

An embodiment herein provides a low alloy high nitrogen steel. The low alloy high nitrogen steel includes iron, and by weight: 0.14-0.60% nitrogen; 0.08-0.28% carbon; 0.10-2.20% nickel; 0.25-2.00% manganese; 1.20-2.70% chromium; 0.45-1.50% tungsten; not more than 0.05% molybdenum; not more than 0.02% vanadium; not more than 0.60% silicon; not more than 0.10% copper; not more than 0.02% titanium; not more than 0.02% niobium; not more than 0.008% aluminum; and not more than 0.02% of any other element with not more than 0.10% total other elements. Cobalt may substitute for any part of nickel in the low alloy high nitrogen steel so as to raise the start temperature of martensite transformation and the transition temperature of the body centered cubic (BCC) to face centered cubic (FCC) crystal lattice phase over temperature interval around 625° C. to 710° C., however use of Co in place of Ni may yield greater delta ferrite during solidification and may lessen solubility of N.

The alloy elements to the left of Fe in the periodic table; e.g., Cr, Mo, and Mn, can promote covalent bonding and enhance clustering, and elements to the right; e.g., Ni and Co, can promote metallic bonding and short range order (SRO). Ab initio calculations and tests with electron spin resonance with interstitial alloy constituents, show that the concentration of free electrons can increase to an optimal level with alloying of N in CrMnCN steels, which can enhance the ductile metallic character of atomic bonding. The N can promote SRO of N and C, Cr, or Mo solutes which can increase the solubility for alloy atoms due to the result of a more even distribution of solutes in the austenitic lattice. The addition of C alone can promote covalent bonding and clustering. Strengthening contributions may be provided by a short range order of N and solutes, which can form a complex solid solution interstitial-solute (i-s) bond strengthening of austenite greater than carbon. In martensite, strengthening may be provided by a high density of dislocations, a non-cubic crystalline symmetry with an effect of lattice distortion, and with tempering, a precipitate strengthening and toughening contribution. A stronger N-dislocation binding energy, enthalpy (H), than from carbon, can interact more strongly with dislocations, and provide a higher level of flow stress. The highest effect of SRO can be obtained with alloys of N+C.

The approach in the low alloy compositions of the embodiments herein assume that the short range order effect from N and the following more even distribution of alloy atoms of austenite can be inherited in the alloy of near complete BCC phase structure upon the FCC to BCC crystal lattice transformation eventually obtained by quenching to and tempering of martensitic low alloy steel. Furthermore, the compositions of the embodiments herein are strengthened by secondary hardening at high temper temperatures. As described later, calculations using Thermo-Calc software (available from Thermo-Calc Software, Inc.) and Schaeffler plots were used to calculate such a possibility. The resultant microstructure having the short range order effect and more even distribution of alloy atoms provides a more refined microstructure to resist initiation of fracture and has improved flow stress and strain hardening. A high level of W and N alloying that is possible without deleterious carbides or clustering of alloy constituents will improve the mechanical strength, toughness, and resistance to corrosion. Contrariwise, the first to solidify steel phase of delta ferrite has low solubility for N. In the pressure cast ingot manufacturing processes for the compositions of the embodiments herein, in the specific low alloy levels of N, C, Mn, Cr, W, and Ni compositions of steel, the N solubility in high temperature austenite at elevated manufacture pressures may be maintained in part through enhancing austenite and limiting delta ferrite by optimal levels of composition and balanced levels of near equal C and N. The delta ferrite is either eliminated or limited to be under a specific amount; for example, 0% or less than 6%, or up to 28%. Furthermore, with Thermo-Calc calculations, the embodiments herein provide two custom test alloys, Fe-1.70Cr-0.80-1.0Ni-0.48W-0.26Mn-0.49Si-0.01V-0.013P-0.006S-0.16C-0.018N, and Fe-1.96Cr-0.82Ni-0.51W-0.25Mn-0.50Si-0.016V-0.011P-0.006S-0.21C-0.018N, by casting ingots, hot work of the alloy ingots into two annealed finished billets of 2712 pounds and 2557 pounds, then further hot working the two alloys into plate shapes of 0.4 inches through 1.4 inches in thickness followed by annealing and finishing in quantities of 1650 pounds and 1550 pounds. These custom alloy plates have been partially tested; and the Fe-1.70Cr-0.80Ni-0.48W-0.26Mn-0.16C-0.18N alloy, despite having elevated levels of S and P, especially has demonstrated novel N steel characteristics with martensitic structure, retained austenite, and shape control of S constituents. The initial trials provide 0.2% yield strength at 200-218 ksi, tensile strength 222-235 ksi and high Charpy V-notch impact toughness of 21-39 Joules following austenitize, quench, and temper processing for temper temperatures from 270° C.-500° C.

The solid state alloy process is an alternative manufacture approach apart from the pressure casting of ingot and may be either conducted by mechanical alloying of powders or by gas-solid diffusion of powders or thin sheets with controlled atmosphere N, with hydrogen or with ammonia gas at specific ranges of temperatures and pressures. The solid state alloy approach is an alloy manufacture process which enhances N solubility without the need to avoid delta ferrite or to enhance high temperature austenite over delta ferrite. While meeting the approach of alloy design, with the capability for low levels of manganese, for example 0.25%, nickel as low as 0.10%, high chromium up to 2.7%, tungsten up to 1.5%, and low to moderate levels of carbon, the solid state alloy process allows minimal austenite content and provides alloys of highly enhanced 0.14% to 0.60% nitrogen and choice of maintaining the transition temperature of the ferritic body centered cubic (BCC) lattice structure to the austenitic face centered cubic (FCC) lattice crystallographic structure at high temperatures. With no need for pressure remelt additive agents such as silicon nitride $Si_3N_4$, the level of silicon may be lessened to improve interstitial solubility of C and N constituents in the steel. With specific compositions of Fe—Cr—Mn—W—C and the higher N level possible, the mechanical alloy process or the gas-solid diffusion methods allow low alloy steel use of low Si, high W, and higher levels of alloying with Cr, up to around 2.7% without tendency for Cr—Cr clustering or to form deleterious carbides.

Hardness of martensitic steels can be dependent upon the level of interstitial C and N content. While still not wishing to be bound by theory, martensite, which can transform crystal lattice in C steels upon cooling, can be formed by dislocation movements and is called lath martensite. Lath martensite contains a high density of dislocations. During the quenching of steel following austenitization to form martensite, carbon interstitial atoms can diffuse and segregate around dislocations or boundaries of microstructure. Hardening contributions of the martensite structure of the low alloy high nitrogen steel alloys according to embodiments herein can be provided by the fine dislocation structure, pinning of the dislocated martensite structure by interstitial atoms C and N, ordering of N with substitutional solutes rather than clustering, and a lattice distortion from C and N which is non-cubic and which serves as an obstacle to dislocation movement.

When quenched, martensite is saturated with interstitial C, reheat stage 1 tempering of conventional C-steel quenched martensite to less than 200° C., can result in precipitation of fine carbides which provides an additional contribution to strengthening; and the martensite which had expanded, shrinks. The second stage of tempering in conventional C-steel can involve transformation of retained austenite to bainite at around 200° C. to 350° C. for which the product of austenite is BCC ferrite and carbide. The third stage in tempering 200° C. to 700° C. in conventional C-steel can involve further decomposition of martensite into BCC ferrite and carbide structures, rapidly and beginning around 250° C. Around 400° C. in the conventional C-steel, the initially formed carbides can dissolve and become replaced by $Fe_3C$ precipitate, which can form preferentially along lath boundaries and former grain boundaries. Around 500° C. to 600° C., recovery of dislocations inherited from the conventional C-steel martensite can take place in the stage 3 ferrite to produce a low-dislocation-density acicular ferrite structure, and on further heating 600° C. to 700° C. the acicular ferrite grains can recrystallize to form an equiaxed ferrite structure.

Elements of conventional steels tend to cluster together; that is the Cr tends to cluster with itself, and the same with Mn, Mo, W, and C. The cluster effects promote formation of carbides, which deplete the matrix of solute elements and the discontinuities of physical and mechanical properties of carbides in the matrix may initiate fracture under load. The compositions of embodiments with N and measured amounts of C, Cr, Mn, W, and N herein can better disperse solutes by short range ordering effects with C and N during heat treatment of austenitization, and following quenching, and during tempering the Fe, Cr, Ni, Mn, W solutes are anticipated to largely resist diffusion more so than C and N, and the composition may thereby achieve a more refined quench and tempered microstructure than conventional C steel. Furthermore, unlike C steels, at high temper temperatures, the embodiments with N compositions which tend to form short range ordered phases may better contribute a secondary hardening effect. In this manner, the compositions of the embodiments can achieve an interstitial content of approximately over 0.80 wt % to provide high strength and hardness combined with ductility from effects of a highly dislocated substructure of martensite, the pinning of martensite dislocations by interstitial N or SRO of N and solute, and the non-cubic long range distortion effect of the martensite. Following austenitization, quench and temper processing in the embodiments herein, a proportion of the matrix will be comprised of N and C enriched and short range ordered austenite phase, which will provide contributions of toughness and ductility, through capabilities for strain hardening and accommodating imposed strain. The alloys of these embodiments can resist formation of coarse carbides, the decomposition of martensite and provide hardening up to around 500° C. rather than the softening of C steel. The initial alloys are iteratively selected by Thermo-Calc software property diagram plots for utility of minimal effects from precipitation of carbides, most specifically cementite, and nitrides; therefore, it appears that there would be an enhanced effect of more finely distributed microstructure. The ordered structures of C and N and solute atoms within high temperature phases during austenitization will largely be retained upon the quenching and tempering due to lower atomic mobility of the larger solute Fe, Cr, Mn, and W atoms. The pinning the dislocations of the quenched austenite martensite structure together with an enhancement of non-cubic distortion of the martensitic lattice may further provide a strengthening effect from dislocation movement and plastic flow. The property diagrams of the low alloys of the embodiments suggests that a high proportion of lath martensite with 1.5 wt % to 2.5 wt % austenite or more can result from a quench or equilibrium process.

N may readily dissolve in liquid steels with high Cr, Mn, Mo, and W contents. The amount of N dissolved in steel liquid under pressure of N may be estimated by Sievert's Law and interaction parameters or by use of the Cr equivalent method of Feichtinger, Satir-Kolorz, and Xiao-Hong. During the first stage of solidification, specific compositions may form a portion of the delta ferrite phase which has low solubility of N. Ni, Mn, C, and N limit or eliminate delta ferrite. With appropriate low alloy Ni, Mn, C, and N contents of the compositions of the embodiments, the amount of delta BCC lattice structure ferrite may be controlled or eliminated so that N dissolved in steel liquid may be more readily directly consolidated in solid steel of the FCC phase. Furthermore, to prevent porosity, the amount of Ni and Co may require adjustment to a minimal level to prevent rejection of N gas from the high temperature austenite. With near equal levels of C and N, or slight excess of C in the low alloy compositions of the embodiments, N is better retained following solidification in high temperature austenite to better resist degassing and gas porosity. Experimental trials reveal that W promotes consolidation of N under pressure from liquid into solid steel further beyond the solubility predicted for liquid steel. From composition, the class of steel; e.g., low-alloy or high alloy, may be determined by total alloy content, or by phase type with use of Cr equivalent and Ni equivalent coordinates on a Schaeffler diagram. A Schaeffler diagram closely distinguishes steel structures as either: ferritic-martensitic; martensitic; austenitic-martensitic; austenitic; martensitic-ferritic; ferritic; martensitic-austenitic-ferritic; and duplex austenitic-ferritic steels.

The activity, $a_i$, of any component in an ideal solution is equal to its mole fraction, and the activity coefficient of a component may be defined as the ratio of the activity of the component to its mole fraction. In the industry, the activity coefficient; i.e., the interaction coefficient, of a component can be defined by the ratio of its activity and mass concentration. For multicomponent or non-ideal alloys of Fe, the solutes "i" affect their solubility and the influence is accounted for by interaction parameters.

An estimate of N solubility in liquid iron at 1600° C. and 1-atmosphere pressure was found to be 0.045 wt % $N_2$. The solubility of N in liquid iron may be determined by N wt $\%=(0.045*p_{N2}^{1/2})/f_N$ in Sievert's Law where solubility of nitrogen is proportional to the square root of pressure. For Fe or dilute solutions, the activity coefficient $f_N$, for low alloy steels with less than 4% by mass percent of each constituent, with multicomponent constituents in Fe, $f_N$ may be represented closely by a series shown in Equation 1 comprised of summed products of solute fractions in percent and their first order interaction parameters, $e_N$, which describe the influence of individual elements, and which may include the action of N on itself, $$\log f_N = e_N^{Cr}*[\%\ Cr]+e_N^{Ni}*[\%\ Ni]+e_N^{Mn}*[\%\ Mn]+e_N^{Mo}*[\%\ Mo]+e_N^{W}*[W]+e_N^{Si}*[\%\ Si]+e_N^{C}*[\%\ C]+e_N^{N}*[\%\ N]. \quad (1)$$

The calculations and experimental results indicate that interaction parameters cannot be calculated ab initio, that researchers obtain different values for their parameters, and that interaction parameters for calculation of N solubility in steels allows a semiquantitative result only. Table 1 lists a set of interaction parameters for solutions of N in steels. Elements with negative interaction parameters assist solution of N in liquid steel, while elements with positive interaction parameters inhibit solution of N in steel. Elements with highly negative values of interaction parameters beyond impurity levels of content are not of interest as main constituents in compositions of the embodiments herein; e.g., the Ti and V constituents, react with N strongly to form nitrides which removes N from solution of either austenitic FCC or BCC lattice phases and do not provide a practical means to assist bringing N and solutes into solution in the matrix to provide the kinds of short range ordering and metallic electronic bonding whereby N may enhance solubility of atoms in HNS. Table 1 provides first order interaction parameters $e_N^X$ for solution of N in iron at 1600° C. (from Satir-Kolorz, 1990).

TABLE 1

| Constituent, X | Interaction parameter |
|---|---|
| Ti | −0.930 |
| V | −0.098 |
| Nb | −0.050 |
| Cr | −0.048 |
| Mn | −0.021 |
| Mo | −0.013 |
| W | −0.002 |
| Cu | 0.006 |
| Co | 0.010 |
| Ni | 0.011 |
| Al | 0.040 |
| Si | 0.043 |
| B | 0.083 |
| C | 0.118 |
| N | 0.13 |

From the above, a Sievert's Law estimate for N solution in multicomponent steel alloys at 1600° C. is: $N\ \%=(0.045*p_{N2}^{1/2})/f_N$.

Compositions 1, 2, and 3 that are adaptable to cast ingot processes according to exemplary embodiments herein are shown in Tables 2 and 3 and Tables 6 through 12. The cast ingot W alloy compositions trend to the lower levels of Cr and N. Compositions 4 that are adaptable to the solid state mechanical alloy of powder or the gas-solid diffusion alloying methods of powder or thin sheet materials according to exemplary embodiments herein are shown in Tables 2 and 3 and Tables 13 and 14.

TABLE 2

| Alloy | Composition |
|---|---|
| 1 | Fe-1.00-1.80Ni, 1.00-1.70Mn, 1.30-1.70Cr, 0.45-0.90W, 0.14-0.18C, 0.14-0.20N, 0.02V |
| 2 | Fe-0.60-2.20Ni, 0.50-2.00Mn, 1.30-1.85Cr, 0.45-0.90W, 0.16-0.20C, 0.16-0.21N, 0.02V |
| 3 | Fe-0.70-1.70Ni, 0.50-2.00Mn, 1.50-1.90Cr, 0.45-1.30W, 0.18-0.22C, 0.18-0.22N, 0.02V |
| 4 | Fe-0.10-1.00Ni, 0.25-1.00Mn, 1.20-2.70Cr, 0.45-1.50W, 0.08-0.28C, 0.24-0.60N, 0.02V |

According to the embodiments herein, methods of making low alloy high nitrogen steels fall within the steels described as low-alloy, with constituents less than 8 wt % alloy elements. Iterative property diagram plots of Thermo-Calc v4.0 2015a and 2016a software and the experimental PESR results of casting, hot rolling plate, and austenitization, quench and temper tests of similar Fe—Cr—Ni—W—Mn—N—C alloys were verified for selection of the compositions. The compositions were referenced to a Schaeffler Ni equivalent versus Cr equivalent phase diagram to verify approximate compositions of the low alloy martensitic steels. Each composition was given upper and lower limits following iterative runs of Thermo-Calc software and included a Sievert's Law estimate for N solution in multicomponent steel. Example objectives for pressure cast or pressurized electroslag remelt cast Compositions 1, 2, and 3 alloys were: (1) to obtain alloy activity coefficients to ensure N solubility in the liquid steels with low alloy compositions; (2) to limit, minimize, or eliminate delta ferrite during initial solidification to minimize any rejection of N during solidification of high temperature delta ferrite; (3) to eliminate or minimize de-gassing and porosity of austenite solid following solidification; and (4) to obtain at specific temperatures of hot working, solution treatment, and tempering, phase structures with absence or near absence of solute and C-clustering formation of graphite, cementite, or complex $M_{23}C_6$ or $M_7C_3$ carbides, rather to obtain more homogeneous short range ordered phases or carbides in form of a fine dispersion of alloy constituents in either austenite, body centered cubic (BCC), or martensitic matrices within respective temperature ranges of FCC austenite and BCC phases. Furthermore, the exemplary embodiment compositions were selected with respect to the level of C, Cr and ratios of Cr/C, N/C, and Cr/N to minimize clustering effect of excess Cr, W, or C, as rather not to achieve high levels of Cr for corrosion resistance or to achieve an austenitic structure with high levels of Ni, Mn or N. The specific levels of Cr, Mn, and W constituents that are within low amounts serve to enhance solubility of N and C in the steel without enhancing the formation of complex carbides. Specific amounts of nitrogen and carbon minimize clustering effects of Cr—Cr or Mn—Mn by i-s interaction with these solutes to form more metallic-like electron bonds. The compositions of the exemplary embodiments can be specifically limited in ranges of solutes and interstitials. For the compositions of the exemplary embodiments, carbon levels more than the composition limits promote cementite and graphite below 700° C.; while a level too low of carbon may promote complex carbides at low temperatures below 400° C. In some embodiments, cast alloys with high N/C ratios or low Mn may result in some porosity during solidification which may be healed at lower temperatures during wrought processing, or pressure over 40 bars may be used during ingot casting.

At 1 bar or more pressure around approximately 540° C. to 800° C., below the lower or upper transformation temperatures of the ferritic BCC to austenitic FCC crystallographic lattice structure, the embodiments of solid state mechanical or gas-solid processed Composition 4 alloys are designed to maximize N content dispersed in ordered phases along with C, vacancies (VA), or alloy solutes. At low temperatures less than around 800° C., the alloys of the embodiments retain N without outgassing. At 1 bar pressure and at elevated temperatures; for example greater than 800° C., some outgassing may occur from free surfaces of the alloys of the embodiments with lowest levels of Cr, and Mn constituents. At more elevated pressures of N, for example 120-250 bars or 12-25 MPa any outgas effect at the high range of temperature over 650° C. to 800° C. may be suppressed. Therefore, in the solid state alloy approach the embodiments of solid state mechanical processed Composition 4 alloys may be processed to end composition beginning with powders or thin sheet from semi-finished composition. As with the listed Composition 4 embodiments, the finish amount of N may be limited before onset of the formation of carbides, for example, $M_7C_3$, and $M_6C$, or graphite and N gas. While meeting design objectives in these high nitrogen low alloy steels, the solid state alloy approach allows use of low levels of Ni, Mn, C, and Si, and higher levels of N, C, W, and Cr than that of pressure cast or pressurized electroslag remelt ingot metallurgy. With low nickel content possible, the solid state process therefore provides a choice of maintaining and elevating the lower transition temperature of the ferritic body centered cubic BCC lattice structure to the austenitic face centered cubic FCC lattice crystallographic structure upward to high temperatures, and allows minimal austenite content during service near ambient conditions.

Moreover, low alloy high nitrogen steel (HNS) martensitic compositions with W that strictly limit or eliminate Mo and that limit Mn and Ni, according to some embodiments, can have properties and structures which were verified with iterative runs of the Thermo-Calc software with a range of solutes and interstitial C and N, to retain or reform strong bonds of hardening and strengthening phases relative to the matrix under conditions of high pressure. These Mo-free W-modified alloys and those with Co can better withstand extreme service conditions of elevated temperature and pressure and may better resist softening than the Mo and non-tungsten-modified alloys.

The embodiments of steel compositions and processing can provide useful microstructures and properties from secondary hardening with temper temperatures of approximately 440° C. to 550° C., over a temper temperature range of about 460° C. to 650° C.

The constituents in compositions of the embodiments can provide specific contribution to microstructure and properties depending on the specific ratios and amounts added. Table 3 shows the role of the substitutional solutes and the interstitials, N and C, in hardening and strengthening of the Fe HNS alloys.

TABLE 3

| Constituent | Process-Specific Design Effect or Role of Constituent |
|---|---|
| Fe | Base alloy, the matrix |
| Ni | Matrix solute, Fe—Ni short range order (SRO), Ni and Mn + Ni toughens |
| Ni | Minimizes, eliminates, delta ferrite during pressurized electroslag remelt (PESR) solidification to improve N level in solid, hardenability |
| Cr | Assist solution of N and C, solid solution hardening (SSH), strong enthalpy (H) bond[1], strong contribution to SRO with N and N + C, corrosion resistance, hardenability |
| Mo | Assist solution of N and C, SSH and SRO strengthening[1] |
| Co | Similar to Ni, but raises the BCC to FCC transition temperature, enhances amount of delta ferrite, raises start temperature of martensite transformation |
| W | Assist solution of N and C, SSH and SRO strengthening at high and low pressures, strong enthalpy strength bond[2] with N and C + N, hardenability |
| Mn | Shape control of S, eliminate FeS. Assist solution of N and C, SSH, minimize solidification defects, improve hardenability, toughens |
| Mn | Minimize & eliminate delta ferrite during solidification to improve N level in solid, highly effective through-thickness hardenability for martensite processing |
| Si | Residual of $Si_3N_4 \rightarrow 3Si + 4N$ PESR additive and an impurity of slag or refractory, improves through-thickness hardenability |
| N | Homogenize solutes, improve hardness, flow strength, corrosion resistance, shock resistance, help limit amount of delta ferrite with Mn + Ni |
| N | Dissolve deleterious carbide, and (FeCuNiCr)3P intermetallic during temper treatment, form SRO structures with Cr, Mo, Mn, W, and C in matrix |
| C + N | Form SRO structures with Cr, Mo, W in matrix, improve mechanical & corrosion properties, minimizes delta ferrite in iron |
| C | Minimize degassing of N in of low alloy HNS when N/C~0.85-1.3, minimizes delta ferrite in iron, provides strength and hardness |

[1]Strong bonding energy relative to the matrix at both low 1-40 bars pressure and high pressures to 34-kbars and 350° C. to ~650-700°; C. throughout the martensitic or BCC, and much of the FCC austenite phase regions, to provide homogenization of solutes and strengthening.
[2]Strong bonding energy relative to the matrix at both 1-40 bars pressure and high pressures to 34-kbars and 350° C. to ~650-700° C. throughout the martensitic or BCC, phase region, to provide homogenization of solutes and strengthening.

Low alloy high to ultra-high strength martensitic steel articles of specific compositions compatible with specific heat treatment processes are provided according to exemplary embodiments. Specific compositions, levels and ranges of Cr, Mn, W, C, and Ni are provided to solutionize N in liquid steel, to allow solidification with little or no delta ferrite and degassing of high temperature austenite, and to obtain structures of alloys with homogeneous distribution of constituent elements in phases according to exemplary embodiments. Along with Cr, Mn, W, and C, the HNS alloys are provided with specific levels of the austenite forming elements N, C, Ni and Mn, and specific ratios of Cr/C and N/C to provide: (1) homogeneous phase structures that can be free of complex carbides with elements dispersed in the structures over a wide range of temperatures and/or wide range of temperature and pressure; (2) alloys that can be manufactured to achieve composition ranges compatible with the variability found in production; e.g., f 0.02-0.03C or N and f 0.05Cr; (3) pressure cast alloys that can achieve specific average range levels of C from 0.14 to 0.22 wt % and with N from around 0.14 to 0.22 wt % as for design of low-alloy high to ultra-high strength martensitic steels; and (4) a martensitic structure that can be obtained from austenitize-quench treatment according to exemplary embodiments. Specific compositions of the embodiments together with solid state processing either at low temperatures for example around 440° C. to 640° C., or high temperatures, for example 880° C. to 1100° C. gain utility of high N contents to 0.60 wt % with the absence of cementite or $M_7C_3$, or $M_{23}C_6$ carbides.

Methods and Compositions

According to an exemplary embodiment herein, the manufacture of low alloy high nitrogen steel compositions of the embodiments may include forming direct to shape by either additive manufacture laser sintering of powder, solid state forming of powders, or squeeze or pressure casting of liquid to solid followed by stress relief, normalization, austenitization and quench-temper heat treatment. According to another exemplary embodiment, the manufacture of low alloy high nitrogen steel compositions of the embodiments may include wrought methods beginning either with material sourced from mechanical alloying or N controlled atmosphere gas-solid alloying, or pressurized electroslag remelt casting of ingots with use of a slag under pressure of N or N plus Ar followed by hot working to billets and shapes followed by heat treatments. In these embodiments of casting under pressure, gas pressure can be maintained at a level above any of cooling water pressure level, and remelting methods can be a preferred method to minimize volume of liquid metal under pressure.

According to another embodiment the manufacture of the low alloy high nitrogen steel compositions may be manufactured in the solid state at low temperatures around near ambient temperature, or higher around 440° C. to 640° C., by either of by mechanical alloying powders or the controlled atmosphere gas-solid diffusion of N, or N with hydrogen, or ammonia assisted N diffusion into powders or thin sheet, followed by consolidation processes of hot isostatic pressing (HIP). For the gas-solid diffusion alloy approach, the powder may be infused with N at low temperature around 440° C. to 640° C. and at atmospheric pressure. Another gas-solid diffusion alloy approach may be by method of elevated temperature greater than 800° C. and at elevated pressure similar to Feichtinger's nitriding method provided in German Patent No. DE 3624622 C2; for example at 175 bars or 17.5 MPa or more during a low pressure hot isostatic press process in which an encapsulated unconsolidated can of porous powder is pressurized by a remote source of N to sufficient pressure to convey the necessary mass of N to meet the finish composition; and coincident the press pressure is maintained with argon gas equal to can pressure along with outside heating of the can. Another solid state powder consolidation approach may include cold isostatic pressing (CIP) extrusion of powder, for example into tubing or a shape, followed by sintering under pressure of controlled atmosphere of N, Ar, and ammonia followed by hot work extrusion, forging, or rolling. Both the HIP and CIP consolidation approaches of powders may end with austenitization, quench, and temper treatments.

The low alloy compositions of the embodiments with Mn and Ni constituents and melting and casting under N or N—Ar pressure can provide capability for casting to shape by squeeze casting or pressure casting methods with qualities of good fluidity. During solidification and cooling of solid metal, the compositions can provide high resistance or immunity to both gas evolution and porosity. The low alloy content balanced in levels of Cr, W, Mn, C, and N can prevent clustering and precipitation of massive carbides and nitrides that can be common in high alloy or higher Cr level compositions. Cast methods may use a pressure chamber with N or N plus Ar atmosphere to remelt a master alloy(s) with or without final addition of N and C. Pressure or squeeze cast melting may have material re-melt stock pre-prepared by PESR, electric induction or arc spray castings. The remelt method can include a method of stirring to initially homogenize alloy content. Ladle refinements may include injection of calcium (Ca), oxygen, nitrogen, and argon to adjust S, C, and N levels. Pouring into molds of specific shape may occur by differential pressure with feed from the bottom of a ladle or crucible. Molds can include risers, gates, and differential cooling to allow directional cooling and solidification and adequate feeding of liquid into the solidifying metal. Solidification can be completed under pressure, at the pressure of melting or at a pressure level greater than pressure at the melt temperature. Following solidification and cooling the cast shapes may be trimmed and rough finished, then heat treated in air or Ar—N inert atmosphere, for stress relief, softening, or austenitization. Austenitization and homogenization temperatures at approximately 890° C. to 920° C. can prevent any excess decarburization or denitriding of the casting surface. For heat treatment at temperatures greater than approximately 800° C., a pressure or atmospheric retort with inert N or N+Ar atmosphere may be used to prevent excess decarburization and denitriding of workpiece surfaces. Below 510° C., N or N+Ar, or N+ammonia or hydrogen mixtures at about one atmosphere may be used to improve surface qualities. Following stress relief, normalizing, and austenitization treatment, a near net shape casting can be quenched then promptly tempered for hardening and toughening; e.g., at temperatures of 200° C. to 300° C. or 520° C. to 650° C. for strength and toughness. A controlled atmosphere of N and Ar+N, ammonia, or N plus hydrogen during temper heat treatment may be used to minimize decarburization and improve surface quality resistance to corrosion. Thermal cycling of normalizing or austenitization, followed by quenching and tempering may be used to refine grain size of castings.

The manufacture of the low alloy high nitrogen steel alloy in wrought form may occur by the PESR method and can begin with melting and casting of a consumable electrode (CE) by either one or more steps of air melt (AM), vacuum induction melt (VIM), argon oxygen decarburization (AOD) with or without calcium injection, or vacuum arc remelt (VAR) with a composition near the final composition of steel with the exception of N and Mn, and the like or combinations thereof, according to exemplary embodiments. Master alloys may be used to ensure solution in the melt of high temperature melting point alloy constituents during the cast of the consumable electrode. The consumable electrode may have a composition of up to or greater than approximate 0.04% or more N for final alloying by PESR to an ingot or other methods. Purity of the CE composition can be selected by first use of including a VIM, AOD with or without calcium injection to remove sulfur (S) or VAR method, by controlling levels of impurities in the melt stock, by control of levels of strong carbide forming constituents Ti, Zr, V, and Nb, and the impurities S, P, As, Sb, Sn, O, and H. V may be added in small amounts; e.g., up to 0.02 wt %, to assist control of grain size during heat treatment and hot rolling. For any composition, it is preferred that the alloy range of more variable interstitials be matched either mid-range and to the corresponding range level of solutes; i.e., high solute matched with a mid to high level interstitials. The PESR process may use high pressures of N; e.g., 40 bars pressure or greater, to remelt under pressure and bring N into solution of the alloy, and to solidify under pressure. The PESR process can ensure temperature and melt rate of the electrode for a progression of ingot solidification in which liquid material is fed gradually to the solidification front. Sievert's Law may be used as an estimate for the necessary alloy compositions to bring N into solution. Thermo-Calc software may be used with specific compositions, temperature, and pressure for design and estimates of phase structure during solidification and heat treatments.

The consumable electrode can be remelted with a PESR plant which immerses the electrode end under a slag and under pressure with $N_2$ gas. The slag may be preheated to ensure dryness at the start of the PESR remelt process. The PESR ingot can be built up in a pressurized, water cooled mold. During PESR remelt processing alternating electric current resistance heats the slag and electrode tip, metal droplets fall through the molten slag and chemical reactions can reduce sulfur and nonmetallic inclusions. N can be added under pressure as necessary to meet the composition requirement by addition of silicon nitride ($Si_3N_4$), or intermetallic compounds of Cr and N, or N gas. Dry N may be added to the furnace to assist solution of N. Low alloy steels of the Compositions 1, 2, 3 embodiments for PESR casting can be subjected to about 40 bars or 580 psia, 4.0 MPa N pressure, and up to about 45 bars or 653 psia, or 4.5 MPa to solutionize N contents. Excess $Si_3N_4$ can result in porosity of the PESR casting or ingot. PESR processing can be performed under optimal conditions of power and melt rate so that solidification structure is directional from bottom to top, fed by liquid, and completed in a manner that results in a solidification structure that is high in density and homogeneity with minimal or no porosity and with minimal segregation in the ingot. Deoxidizers may be added as necessary to the slag. A proper melt rate and power setting can be used to provide an absence of segregation and shrinkage.

Following casting, cast ingots can be homogenized at elevated temperatures of about 870° C. to about 1120° C. for a sufficient time to solutionize elemental constituents, lessen segregation, and to bring the ingot to a uniform high temperature to allow plastic deformation of the steel ingot. Homogenization of the alloy ingot to lessen segregation and for solution treatment can be performed followed by hot work to billets and plate or structure shapes with hot work performed with increments of reduction and reheating as needed. Following homogenization or as part of homogenization, the ingots can be mechanically hot worked by rolling, forging, hammering, or squeezing to improve the steel by closing any small cavities or voids, breaking up and dispersing solutes and any small impurities, and recrystallizing and refining the grain structure to a more homogeneous product which may be a bloom or billet. To make billets the steel can be shaped into blooms then further incrementally reduced in a mill. Each time the ingot is forced through rolls, it can be reduced in one dimension. After one or two passes the steel may be turned to bring the side surfaces under the rolls for a more uniform material. After the steel is hot rolled it may then be flattened at a low range of hot roll temperature, the uneven ends can be sheared off and the length cut to shorter lengths. Mill scale and surface defects can be removed from the surfaces. The product billet may be stress relief annealed at low temperature to minimize residual stress and to soften the steel for handling, cutting, surface finishing, and shipping.

By mechanical hot working, for example, by heating uniformly then rolling beginning with incremental reductions at temperatures of around 1050° C. to 1120° C., billet, blooms, or slabs may be used to manufacture end products which may be plate shapes. Wrought products can minimize hot work temperature and have multipass shape reduction with reductions at about 1050° C. to about 1080° C. with finish roll passes at about 1000° C. to about 1040° C. Hot work and homogenization may include slow heating with low temperature holds around 580° C. and 880° C. before heating to higher temperatures.

Finish hot rolling of final passes through rolls may be used at the lower temperatures of about 1000° C. to about 1040° C. to improve impact toughness and refine grain size. Slabs can be used for rolling of large plate shapes. The roll process may include increments of rolling down to rough thickness, followed by rough flattening around 850° C. to about 930° C. and stress relief anneal with cooling slowly and to a hold at about 580° C. to about 610° C., a softening anneal at about 580° C. to about 610° C., followed by finish flattening and air cooling, then mechanical surface finishing. The alloys that contain cobalt (Co) may require annealing temperatures adjusted upwards by 30° C. to 40° C. or greater. Mechanical finishing during and following billet and plate manufacture may include removal of mill scale by jets of water, grit blast, brushing, followed by surface grinding, and sanding to remove surface defects and oxide scale and to bring dimension to the shape.

Trimming of ingots or hot worked shapes by mechanical or flame or plasma cutting may be performed. Grinding or sanding may be used to finish surfaces or to remove any defects. The specific method may be chosen based, for example, on the specific stage of processing from ingot to product.

The forming into shape of the solid state mechanical alloyed or controlled atmosphere gas-solid alloyed powders by the sintering process may occur first with handling under N atmosphere sealing inside a can or envelope followed by cold isostatic pressing compaction to reduce bulk, then sintering under controlled N atmosphere at pressures of 120 to 250 bars and temperatures of 1150° C. to 1400° C. The higher 1315° C. to 1400° C. sinter temperatures provide greater near theoretical density, the lower temperatures provide finer grain size. The sintered product may be further consolidated to full density by hot extrusion, forging, or rolling.

Alternatively, for consolidation forming by hot isostatic pressing, the finish composition solid state mechanically alloyed or controlled atmosphere gas-solid alloyed powders or thin sheets may be packaged under controlled N atmosphere, vacuum evacuated, consolidated or not by cold isostatic pressing, then densified by hot isostatic pressing at temperatures of 1150° C. to 1250° C. and pressures of 1000 bars to 1500 bars or 100 MPa to 150 MPa. The powder may be brought to N composition by controlled atmosphere treatment in a rotary oven.

Alternatively, by Feichtinger's nitriding method provided in German Patent No. DE 3624622 C2, the powder or thin sheets with sufficient open space in form of semi-finished composition may be infused with N to average finish composition by remote charging of the can packaged powders or sheet with sufficient mass level of N by pressure, and with equal pressure of the applied hot isostatic press, heated by outside energy source inside the hot isostatic press then held at temperatures of 450° C. to 650° C. or ideally at more elevated temperature of over 820° C.

Both the sintering and HIP methods may use hot work by extrusion or forging or rolling followed by heat treatment austenitization, quench and tempering. Alternatively, the solid state alloyed powder may be consolidated by packaging, evacuation under vacuum, cold isostatic pressing to remove bulk, then hot extrusion, followed by austenitization, quench, and temper heat treatments.

According to exemplary embodiments, specific heat treatments prior to the final austenitization and following hot rolling, stress relief, soften annealing, finish flattening, air cooling, and surface grinding and sanding may include normalization heat treatment at temperatures around 870° C. to about 1020° C., by heating to and holding at temperature, followed by air cool of the product. The normalize treatment is to bring into solution any gross segregated or precipitates of constituents of the alloy, to homogenize solutes, to refine grain size and any precipitates, and to avoid residual stress during cooling.

According to exemplary embodiments, the low alloy high nitrogen steel composition, with or without prior normalizing heat treatment, can undergo an austenitization process heat and/or thermomechanical treatment followed by quenching and tempering. The austenitization can include the heating of the composition according to the embodiments herein to a temperature at which it changes crystal lattice structure from BCC ferrite to FCC austenite, followed by a quench or air cooling specifically to harden the steel. An austenitization treatment can be performed near 890° C. to about 950° C., or at a sufficient temperature and time to uniformly heat and solutionize many of the N and alloy constituents in FCC austenitic phases, but with a low enough temperature to avoid excessive grain growth, eliminate quench microcracking, or to avoid formation of excess surface scale or porosity. The exact process time-temperature schedule can be verified by microstructure and mechanical property tests for each alloy so as to obtain the required grain size, hardness, strength levels, impact toughness, and fracture toughness. At high temperatures of normalizing or austenitizing an inert atmosphere mainly of argon gas (Ar) with nitrogen may be used to minimize surface decarburization, denitriding, or oxidation. The heating rate may be gradual or stepped first to around 580° C. to 650° C., held briefly, and then heated to the austenitization temperature.

Quenching from the austenitization temperature can proceed directly without delay, or may include an intermediate temperature hold, or a final roll thermomechanical treatment. The quench media may include forced or still air, water spray, warmed agitated polymer-water solution or oil, liquid salt, and the like, or specific combinations thereof.

Quenches may either proceed immediately directly from austenitization temperatures, from thermomechanical treatment (TMT) final hot roll reduction process, or from intermediate hold temperatures. For example, a quench may proceed by quenching the alloy of the embodiment directly into oil held at about 38° C. to about 177° C., or polymer plus water solution at about 27° C. to 66° C., followed or not, by a temper treatment or by freezing and holding to less than about −20° C. down to about −78.5° C. or lower as desired upon end application and alloy, and required resultant product hardness and toughness by control of the level of any retained austenite and to more further complete transformation to a martensitic structure. As another example, an intermediate quench may proceed by quenching the alloy of the embodiment into media at about 460° C. to about 550° C. and held at temperature, referred to as austemper, consistent with secondary hardening at, for example, about 460° C. to about 510° C., followed by a quench to lower temperature as described.

Temper methods can immediately follow austenitization and quench and may use a single temper step or multiple temper steps. The multiple temper steps can proceed with or without a following chill, for example, cryogenic or about −20° C. to about −78.5° C., including a hold step at chill temperature. A single temper step can include one initial temper followed by a quench to ambient temperature with or without a following chill for example, cryogenic or about −20° C. to about −78.5° C., including hold step at chill temperature, followed by a final temper. The temper step can include a thermomechanical treatment (TMT) prior to quenching. The temper step can include an austemper step; e.g., a quench to and hold at about a 440° C. to about 550° C. temperature range followed by a lower temperature quench and an optional second temper. An autotemper step may include a soft quench; for example, by air convection or forced air quench entirely or as a portion of a temper process. Normalizing may include air cooling to an ambient temperature. A steel alloy of the embodiments herein tempered at less than 440° C. can be referred to as a primary hardened alloy. Whereas a steel alloy of the embodiments tempered at greater than 440° C. can be referred to as a secondary hardened alloy.

Figure 1A:
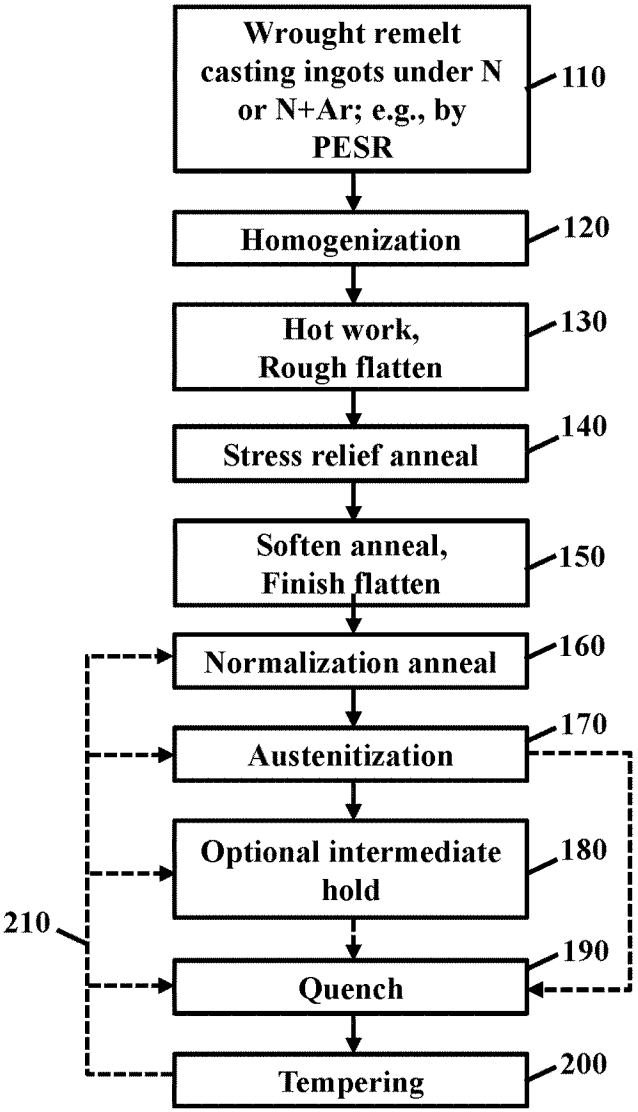
FIG. 1A is a flow diagram illustrating a cast ingot and wrought hot work method of making a low alloy high nitrogen steel according to an embodiment herein.

FIG. 1A is a flow diagram illustrating a method of making a low alloy high nitrogen steel according to an embodiment herein. Operation 110 represents providing wrought remelt casting ingots under N; e.g., by PESR, of the low alloy high nitrogen steel composition according to the embodiments herein. In operation 120 of the method, the low alloy high nitrogen steel composition can undergo homogenization as described. In operation 130 of the method, low alloy high nitrogen steel composition can undergo hot work followed by rough flattening or straightening. In operation 140 the low alloy high nitrogen steel composition can undergo a stress relief anneal process. In operation 150, the low alloy high nitrogen steel composition can be subjected to a softening anneal process followed by a finish flattening or straightening, and in operation 160 the composition can be subjected to a normalization anneal process. In operation 170 of the method, the composition can undergo austenitization. In operation 180, during quenching, the method can have an optional intermediate hold. Operation 190 represents a quench directly from austenitization in operation 170, or directly from the optional intermediate hold in operation 180. The method can further include tempering of the low alloy high nitrogen steel composition in operation 200. To refine grain size as described, in operation 210, the method can include repeating normalizing (160), austenitizing (170), quenching (190), with or without the optional intermediate hold (180), and tempering (200); or repeated normalizing (160) steps may be performed. To lower amounts of residual austenite following austenitization and quench, multiple steps (200) of tempering may be performed.

FIG. 1B is a flow diagram illustrating another method of making a low alloy high nitrogen steel according to an embodiment herein. In the illustrated method of FIG. 1B, squeeze or pressure casting direct to shape; for example, by remelt PESR, of the low alloy high nitrogen composition can be performed in operation 310. In operation 320, the method can include stress relief annealing the low alloy high nitrogen steel composition. As illustrated by operation 330, the low alloy high nitrogen steel composition can be subjected to a normalizing anneal process, and in operation 340 of the method, the composition can undergo austenitization. In operation 350, during quenching, the method can have an optional intermediate hold. Operation 360 represents a quench directly from austenitization in operation 340, or directly from the optional intermediate hold in operation 350. The method can further include tempering of the low alloy high nitrogen steel composition in operation 370. In operation 380, the method can include repeating normalizing (330) or austenitizing (340), quenching (360), with or without the optional intermediate hold (350), and tempering (370) to refine grain size as described.

Figure 1D:
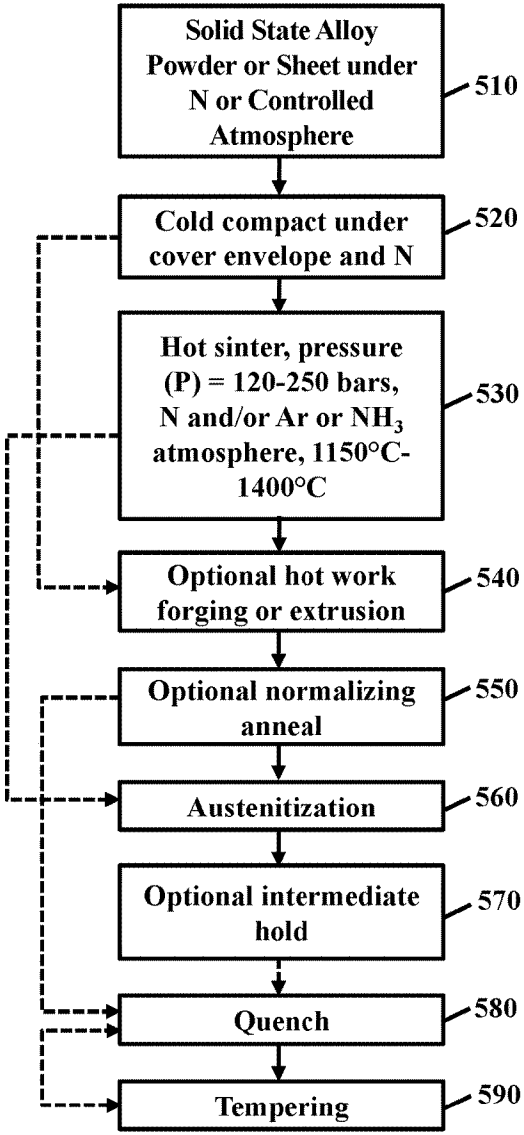
FIG. 1D is a flow diagram showing a solid state alloying plus cold isostatic press, pressure sintering, plus wrought hot work method of making a low alloy high nitrogen steel according to embodiments herein.
Figure 1C:
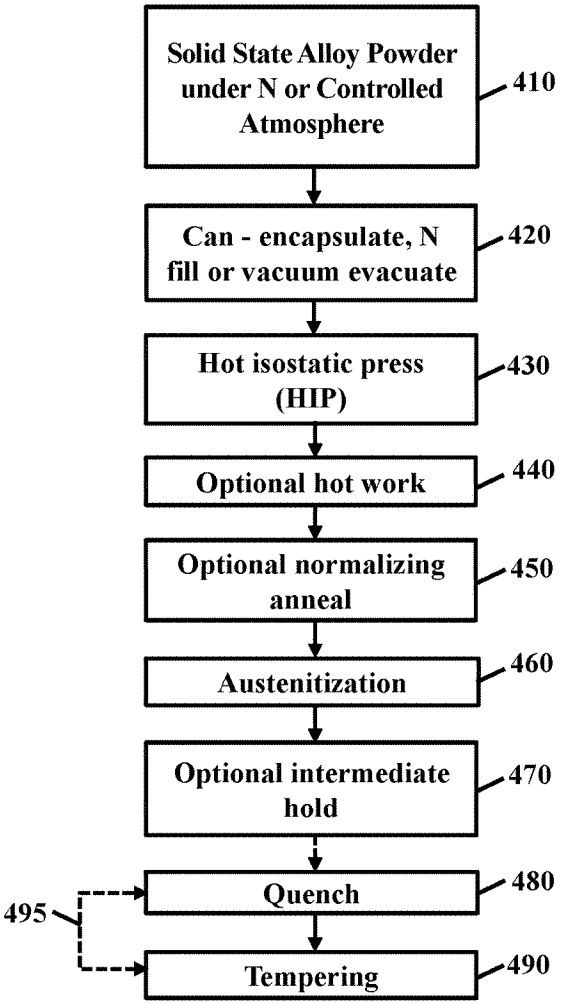
FIG. 1C is a flow diagram showing a solid state alloying plus hot isostatic pressure methods of making a low alloy high nitrogen steel according to embodiments herein.

FIG. 1C is a flow diagram showing another method of making a low alloy high nitrogen steel according to an embodiment herein. In operation 410 of the illustrated method of FIG. 1C, solid state alloying can be performed and may begin with a powder near the low alloy high nitrogen finish composition for example by N gas-solid mechanical alloying to the finish composition. Another method of alloying to finish composition of a powder or thin sheet material may be achieved by controlled atmosphere gas-solid diffusion such as with N or an ammonia stream for gas-solid alloying. A rotary furnace may be used for gas-solid alloying of powder. The alloying of N into powders or thin sheet may occur both within a hot isostatic press and the encapsulating can which is connected to a source of variable N pressure sufficient to convey the required mass of N for alloying and equal to the surrounding isostatic pressure of argon; and while equal pressure is maintained the furnace may be brought to N diffusion temperature. In operation 420, the method may include canning under N atmosphere the powders or sheets of the low alloy high nitrogen steel composition then performing an optional vacuum evacuation. As illustrated by operation 430, the nitrogen filled or vacuum encapsulated low alloy high nitrogen steel composition powder or sheets may be subjected to a hot isostatic process, and in operation 440 of the method, the composition may undergo optional hot work to shape. In operation 450 the method may involve an optional normalizing anneal. Operation 460 represents an austenitization process followed by an optional intermediate hold in operation 470, and quench in operation 480. The method may further include tempering of the low alloy high nitrogen steel composition in operation 490. In operation 495, the method may include repeating tempering (490) and quenching (480), to lessen any amount of residual austenite.

FIG. 1D is a flow diagram showing another method of making a low alloy high nitrogen steel according to an embodiment herein. In the illustrated method of FIG. 1D, the solid state alloying of powder or thin sheet material of the low alloy high nitrogen composition may be performed in operation 510. In operation 520, the method may include enclosure within an envelope and cold isostatic compaction or pressing under N atmosphere, followed by choice of either operation 530 hot sintering under N or controlled atmosphere with pressure, for example of 120-250 bars, or operation 540 hot work forging or extrusion. An optional normalize treatment with soft quench may be performed in operation 550. Hardening and toughening of material may be performed by an austenitization operation 560, followed by optional operation 570 involving an intermediate hold, followed by a quench 580 operation and a tempering operation 590. The various operations may be performed in various steps depending on whether the optional operations are performed, and as denoted by the dashed lines in FIG. 1D.

Figure 1E:
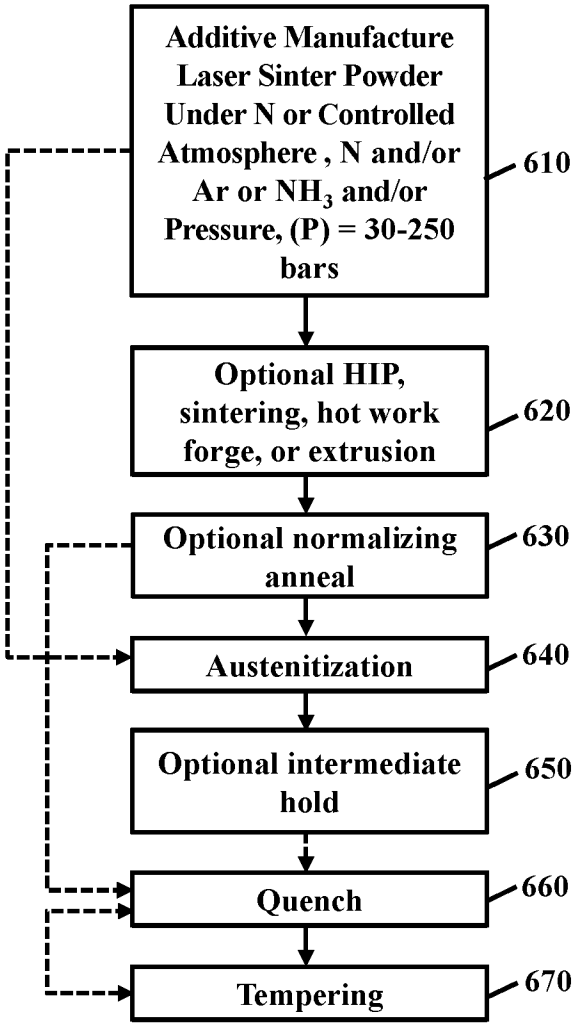
FIG. 1E is a flow diagram showing additive manufacture laser sinter consolidation of welding powder into solid form or shape, followed by optional sintering under pressure or wrought hot work, followed by austenitization, quench and temper method of making a low alloy high nitrogen steel according to embodiments herein.

FIG. 1E is a flow diagram showing additive manufacture laser sinter consolidation of welding powder into solid form or shape, followed by optional sintering under pressure or wrought hot work, followed by austenitization, quench and temper method of making a low alloy high nitrogen steel according to embodiments herein. In operation 610, additive manufacture by laser sinter welding of powder into shape may be performed. In operation 620, the method may include hot isostatic pressing, sintering, hot work forging or extrusion. An optional normalize treatment with soft quench may be performed in operation 630. Hardening and toughening of the material may be performed by an austenitization operation 640, followed by an optional operation 650 involving an intermediate hold, followed by a quench 660 operation, and a tempering operation 670. The various operations may be performed in various steps depending on whether the optional operations are performed, and as denoted by the dashed lines in FIG. 1E.

Table 4 provides ranges of approximate process temperatures according to exemplary embodiments for wrought hot work and heat treat operations shown in FIGS. 1A, 1B, 1C, 1D, and 1E.

TABLE 4

| | |
|---|---|
| a. Homogenization: casting, ingot, bloom, billet, shape | 870-1121° C. |
| b. Hot work; e.g. roll billet and plate | 1050-1121° C. |
| c. Hot work, finish roll plate | 1000-1040° C. |
| d. Rough hot flatten | 850-980° C. |
| e. Normalizing: casting, ingot, bloom, billet, shape | 870-1020° C. |
| f. Austenitization: casting, ingot, bloom, billet, shape | 890-950° C. |
| g. Stress relief, slow cool to/hold: casting, bloom, billet, shape | 580-650° C. |
| h. Soften Anneal, hold/air cool: casting, ingot, bloom, billet, shape | 580-650° C. |
| i. TMT low | 860-910° C. |
| j. Finish warm flatten | 580-650° C. |
| k. TMT high | 910-1000° C. |
| l. Temper (primary, hardening) | 200-440° C. |
| m. Temper (secondary, hardening) | 440-600° C. |

Table 5 presents composition ranges of the low alloy high nitrogen steel according to exemplary embodiments.

TABLE 5

Chemical Composition Ranges

| Element | Weight (mass) percent |
|---|---|
| Nitrogen (N) | 0.14-0.60 |
| Carbon (C) | 0.08-0.28 |
| Nickel (Ni) | 0.10-2.20 |
| Manganese (Mn) | 0.25-2.00 |
| Chromium (Cr) | 1.20-2.70 |
| Tungsten (W) | 0.45-1.50 |
| Molybdenum (Mo) | 0.05 |
| Vanadium (V) | 0.02 |
| Silicon (Si) | 0.60 |
| Copper (Cu) | 0.10 |
| Titanium (Ti) | 0.02 |
| Niobium (Nb) | 0.02 |
| Aluminum (Al) | 0.008 |
| Sulfur (S) | 0.008* |
| Phosphorous (P) | 0.015* |
| Oxygen (O) | 10-40 ppm* |
| Hydrogen (H) | 4 ppm* |
| Antimony (Sb) | 0.005* |
| Tin (Sn) | 0.005* |
| Arsenic (As) | 0.005* |
| Others, Each | 0.02 |
| Others Total | 0.10 |

Single values = maximums as objectives;

TABLE 5-continued

| Chemical Composition Ranges | |
|---|---|
| Element | Weight (mass) percent |

Co may substitute for any part of Ni;

Parts per million = ppm

*Impurities of S, P, H, O, Sb, Sn, are preferred to be held to as low as possible levels based on electrode and PESR methods, Mn typically 0.50-1.90%.

Example compositions of alloys were developed and are presented here as illustrative embodiments and not for the purpose of limitation. Single values are maximums. Examples of phase constituents of the alloys which provide a more uniform distribution of elemental constituents are as follows: FCC_A1 (Fe,Mn,Cr,Mo,V,Si,S,W)(VA,CN) where VA is a lattice vacancy; FCC_A1#2 (Cr,Fe,Mn,Mo,Ni,Si,S,V,W)(C,N,VA); MC_SHP (Mo,W)(C,N); and BCC_A2 (Fe,Mn,Ni,Cr,Mo,V,Si,S,W)(VA,CN)3. Table 6 provides Example Composition 1 low alloy (LA) with 0.14 to 0.18 C and 0.14-0.20 N objective.

TABLE 6

| Composition 1 - Chemical Composition Limit Ranges | |
|---|---|
| Element | Weight (mass) percent |
| Nitrogen (N) | 0.14-0.20 |
| Carbon (C) | 0.14-0.18 |
| Nickel (Ni) | 1.00-1.80 |
| Manganese (Mn) | 1.00-1.70 |
| Chromium (Cr) | 1.30-1.70 |
| Tungsten (W) | 0.45-0.90 |
| Molybdenum (Mo) | 0.05 |

Specific alloys of Example Composition 1 with 0-0.008 wt % gas and 0 wt % delta ferrite at 40 bar solidification and cooling are presented in Table 7.

TABLE 7

| Cr | Ni | Mn | W | Si | V | N | C |
|---|---|---|---|---|---|---|---|
| 1.30 | 1.60 | 1.60 | 0.75 | 0.50 | 0.02 | 0.14 | 0.14 |
| 1.30 | 1.70 | 1.60 | 0.75 | 0.50 | 0.02 | 0.16 | 0.14 |
| 1.30 | 1.60 | 1.40 | 0.90 | 0.50 | 0.02 | 0.16 | 0.14 |
| 1.30 | 1.50 | 1.60 | 0.75 | 0.50 | 0.02 | 0.18 | 0.14 |
| 1.70 | 1.20 | 1.60 | 0.75 | 0.50 | 0.02 | 0.17 | 0.17 |

Table 8 provides Example Composition 2 low alloy (LA) with 0.16 to 0.20 C and 0.16-0.21 N objective.

TABLE 8

| Composition 2 - Chemical Composition Limit Ranges | |
|---|---|
| Element | Weight (mass) percent |
| Nitrogen (N) | 0.16-0.21 |
| Carbon (C) | 0.16-0.20 |
| Nickel (Ni) | 0.60-2.20 |
| Manganese (Mn) | 0.50-2.00 |
| Chromium (Cr) | 1.30-1.85 |
| Tungsten (W) | 0.45-0.90 |
| Molybdenum (Mo) | 0.05 |

Specific alloys of Example Composition 2 with 0-0.008 wt % gas and 0 wt % to 19 wt % delta ferrite at 40 bar solidification and cooling are presented in Table 9.

TABLE 9

| Cr | Ni | Mn | W | Si | V | N | C |
|---|---|---|---|---|---|---|---|
| 1.30 | 1.60 | 1.60 | 0.75 | 0.50 | 0.02 | 0.16 | 0.16 |
| 1.30 | 1.60 | 1.60 | 0.90 | 0.50 | 0.02 | 0.16 | 0.16 |
| 1.60 | 1.70 | 0.80 | 0.75 | 0.50 | 0.02 | 0.16 | 0.16 |
| 1.60 | 1.80 | 0.80 | 0.75 | 0.50 | 0.02 | 0.16 | 0.16 |
| 1.60 | 2.00 | 0.80 | 0.75 | 0.50 | 0.02 | 0.16 | 0.16 |
| 1.40 | 1.60 | 1.60 | 0.75 | 0.50 | 0.02 | 0.18 | 0.16 |
| 1.50 | 1.60 | 1.60 | 0.75 | 0.50 | 0.02 | 0.18 | 0.16 |
| 1.60 | 1.60 | 1.60 | 0.75 | 0.50 | 0.02 | 0.18 | 0.16 |
| 1.60 | 1.20 | 1.70 | 0.75 | 0.50 | 0.02 | 0.18 | 0.16 |
| 1.70 | 1.00 | 0.80 | 0.90 | 0.50 | 0.02 | 0.18 | 0.16 |
| 1.70 | 1.00 | 0.50 | 0.50 | 0.50 | 0.02 | 0.19 | 0.16 |
| 1.70 | 1.20 | 0.60 | 0.50 | 0.50 | 0.02 | 0.18 | 0.16 |
| 1.70 | 1.20 | 1.70 | 0.75 | 0.50 | 0.02 | 0.18 | 0.16 |
| 1.70 | 1.00 | 1.00 | 0.70 | 0.50 | 0.02 | 0.18 | 0.16 |
| 1.70 | 1.60 | 1.60 | 0.75 | 0.50 | 0.02 | 0.18 | 0.16 |
| 1.60 | 0.80 | 1.90 | 0.75 | 0.50 | 0.02 | 0.19 | 0.17 |
| 1.65 | 0.60 | 1.90 | 0.75 | 0.50 | 0.02 | 0.19 | 0.17 |
| 1.80 | 1.00 | 1.90 | 0.75 | 0.50 | 0.02 | 0.20 | 0.16 |
| 1.80 | 0.80 | 1.90 | 0.75 | 0.50 | 0.02 | 0.20 | 0.16 |

Table 10 provides Example Composition 3 low alloy (LA) with 0.18 to 0.22 C and 0.18-0.22 N objective.

TABLE 10

| Composition 3 - Chemical Composition Limit Ranges | |
|---|---|
| Element | Weight (mass) percent |
| Nitrogen (N) | 0.18-0.22 |
| Carbon (C) | 0.18-0.22 |
| Nickel (Ni) | 0.60-1.70 |
| Manganese (Mn) | 0.50-2.00 |
| Chromium (Cr) | 1.50-1.90 |
| Tungsten (W) | 0.45-1.30 |
| Molybdenum (Mo) | 0.05 |

Specific alloys of Example Composition 3 with 0-0.008 wt % gas and 0 wt % delta ferrite at 40 bar solidification and cooling are presented in Table 11.

TABLE 11

| Cr | Ni | Mn | W | Si | V | N | C |
|---|---|---|---|---|---|---|---|
| 1.30 | 1.60 | 1.60 | 0.75 | 0.50 | 0.02 | 0.18 | 0.18 |
| 1.60 | 1.50 | 1.80 | 0.75 | 0.50 | 0.02 | 0.18 | 0.18 |
| 1.60 | 1.20 | 1.70 | 0.75 | 0.50 | 0.02 | 0.18 | 0.18 |
| 1.70 | 1.40 | 1.00 | 0.85 | 0.50 | 0.02 | 0.18 | 0.18 |
| 1.75 | 1.40 | 1.20 | 0.95 | 0.50 | 0.02 | 0.18 | 0.18 |
| 1.70 | 0.80 | 1.70 | 0.95 | 0.50 | 0.02 | 0.19 | 0.18 |
| 1.75 | 1.40 | 1.00 | 0.90 | 0.50 | 0.02 | 0.18 | 0.18 |
| 1.75 | 1.60 | 0.80 | 0.80 | 0.50 | 0.02 | 0.18 | 0.18 |
| 1.60 | 1.00 | 1.90 | 0.75 | 0.50 | 0.02 | 0.19 | 0.18 |
| 1.70 | 0.90 | 1.80 | 0.95 | 0.50 | 0.02 | 0.19 | 0.19 |
| 1.60 | 0.80 | 1.90 | 0.75 | 0.50 | 0.02 | 0.19 | 0.18 |
| 1.70 | 1.40 | 1.70 | 0.75 | 0.50 | 0.02 | 0.19 | 0.19 |
| 1.75 | 1.10 | 1.60 | 0.90 | 0.50 | 0.02 | 0.19 | 0.19 |
| 1.75 | 1.20 | 1.60 | 0.90 | 0.50 | 0.02 | 0.19 | 0.19 |
| 1.80 | 1.40 | 1.60 | 0.90 | 0.50 | 0.02 | 0.19 | 0.19 |
| 1.80 | 1.00 | 1.80 | 0.75 | 0.50 | 0.02 | 0.20 | 0.18 |
| 1.80 | 0.80 | 1.90 | 0.75 | 0.50 | 0.02 | 0.20 | 0.18 |

Specific alloys of Example Composition 3 with 0-0.008 wt % gas and 0 wt %-10 wt % delta ferrite during solidification and cooling at 40 bars or as noted greater pressure are presented in Table 12.

TABLE 12

| Cr | Ni | Mn | W | Si | V | N | C | Note |
|---|---|---|---|---|---|---|---|---|
| 1.70 | 1.00 | 0.50 | 0.70 | 0.50 | 0.02 | 0.18 | 0.20 | 9.1% ferrite, 0.008% gas |
| 1.70 | 1.00 | 0.70 | 0.70 | 0.50 | 0.02 | 0.18 | 0.20 | 5.4% ferrite, 0.008% gas |
| 1.70 | 1.00 | 1.00 | 0.70 | 0.50 | 0.02 | 0.18 | 0.20 | 0.0% ferrite, 0.002% gas |
| 1.65 | 1.00 | 1.00 | 0.70 | 0.50 | 0.02 | 0.18 | 0.20 | 0.0% ferrite, 0.003% gas |
| 1.65 | 1.00 | 0.80 | 0.70 | 0.50 | 0.02 | 0.18 | 0.20 | 3.6% ferrite, 0.006% gas |
| 1.65 | 1.00 | 0.70 | 0.70 | 0.50 | 0.02 | 0.18 | 0.20 | 5.5% ferrite, 0.007% gas |
| 1.75 | 1.00 | 0.80 | 0.70 | 0.50 | 0.02 | 0.18 | 0.20 | 3.5% ferrite, 0.000% gas |
| 1.70 | 0.90 | 1.85 | 1.00 | 0.50 | 0.02 | 0.20 | 0.20 | 40 bars, 0.010 wt % gas |
| 1.70 | 0.90 | 1.85 | 1.00 | 0.50 | 0.02 | 0.20 | 0.20 | 44 bars, 0.002 wt % gas |
| 1.70 | 0.90 | 1.85 | 1.00 | 0.50 | 0.02 | 0.20 | 0.20 | 45 bars, 0.000 wt % gas |
| 1.70 | 0.90 | 1.70 | 1.00 | 0.50 | 0.02 | 0.20 | 0.20 | 44 bars, 0.004 wt % gas |
| 1.70 | 0.90 | 1.70 | 1.00 | 0.50 | 0.02 | 0.20 | 0.20 | 45 bars, 0.001 wt % gas |
| 1.70 | 0.90 | 1.70 | 1.00 | 0.50 | 0.02 | 0.20 | 0.20 | 46 bars, 0.000 wt % gas |
| 1.70 | 0.90 | 1.85 | 1.25 | 0.50 | 0.02 | 0.20 | 0.20 | 0% ferrite, 0.004% gas |
| 1.75 | 0.80 | 1.90 | 1.00 | 0.50 | 0.02 | 0.20 | 0.20 | 0% ferrite, 0.008% gas |
| 1.85 | 1.00 | 1.65 | 1.30 | 0.50 | 0.02 | 0.20 | 0.20 | 0% ferrite, 0.007% gas |

Table 13 provides Example Composition 4 low alloy (LA) steel with 0.08 to 0.28 C and 0.24-0.60 N which is capable of solid state alloying to composition at 1 bar pressure or more with absence of gas phase at temperatures below the upper transformation temperature and around 350° C. to 540° C., and at rapid rates above 800° C. at moderate pressures around 120 to 250 bars or 12 to 25 MPa. Composition 4 alloys may be made free of carbide or graphite constituents following the embodiments of consolidation, austenitization and quench and temper processing.

TABLE 13

| Composition 4 - Chemical Composition Limit Ranges | |
|---|---|
| Element | Weight (mass) percent |
| Nitrogen (N) | 0.24-0.60 |
| Carbon (C) | 0.08-0.28 |
| Nickel (Ni) | 0.10-1.00 |
| Manganese (Mn) | 0.25-1.00 |
| Chromium (Cr) | 1.20-2.70 |
| Tungsten (W) | 0.45-1.50 |
| Molybdenum (Mo) | 0.05 |

Specific alloys of Example Composition 4 with enhanced levels of Cr and N, low to high C, low levels of Si, and low to moderate levels of Ni or Mn are presented in Table 14. The specific Example Composition 4 alloys shown in Table 14 reveal over wide ranges of composition, the manner in which N, C, Cr, and W may be both balanced and enhanced fully within the embodiments. Thermo-Calc models reveal specific Example Composition 4 alloys have minimal or no $M_{23}C_6$, $M_7C_3$, or $M_6C$ carbides over a wider range of temperature. The lower temperature limit at 1 atmosphere pressure below which no equilibrium state gas forms from free surfaces in these specific Example Composition 4 alloys is 740° C. to 817° C. These Composition 4 alloys have significantly less propensity for carbides than the Example Composition 1, 2, and 3 alloys which must meet issues of rejection of gas during solidification of any delta ferrite and at high temperatures in austenite.

TABLE 14

| Cr | Ni | Mn | W | Si | N | C |
|---|---|---|---|---|---|---|
| 1.40 | 0.20 | 0.30 | 1.00 | 0.15 | 0.26 | 0.14 |
| 1.70 | 0.40 | 0.25 | 0.70 | 0.20 | 0.27 | 0.18 |
| 1.70 | 0.10 | 0.40 | 1.20 | 0.15 | 0.34 | 0.16 |

TABLE 14-continued

| Cr | Ni | Mn | W | Si | N | C |
|---|---|---|---|---|---|---|
| 1.70 | 0.20 | 0.25 | 1.20 | 0.20 | 0.32 | 0.18 |
| 1.80 | 0.10 | 0.50 | 1.20 | 0.15 | 0.34 | 0.18 |
| 2.00 | 0.20 | 0.60 | 1.40 | 0.15 | 0.40 | 0.20 |
| 2.30 | 0.60 | 0.60 | 1.10 | 0.50 | 0.40 | 0.20 |
| 2.40 | 0.20 | 0.60 | 1.40 | 0.15 | 0.50 | 0.20 |
| 2.50 | 0.20 | 0.25 | 1.20 | 0.20 | 0.40 | 0.28 |
| 2.70 | 0.20 | 0.40 | 1.50 | 0.15 | 0.60 | 0.20 |

Figure 2A:
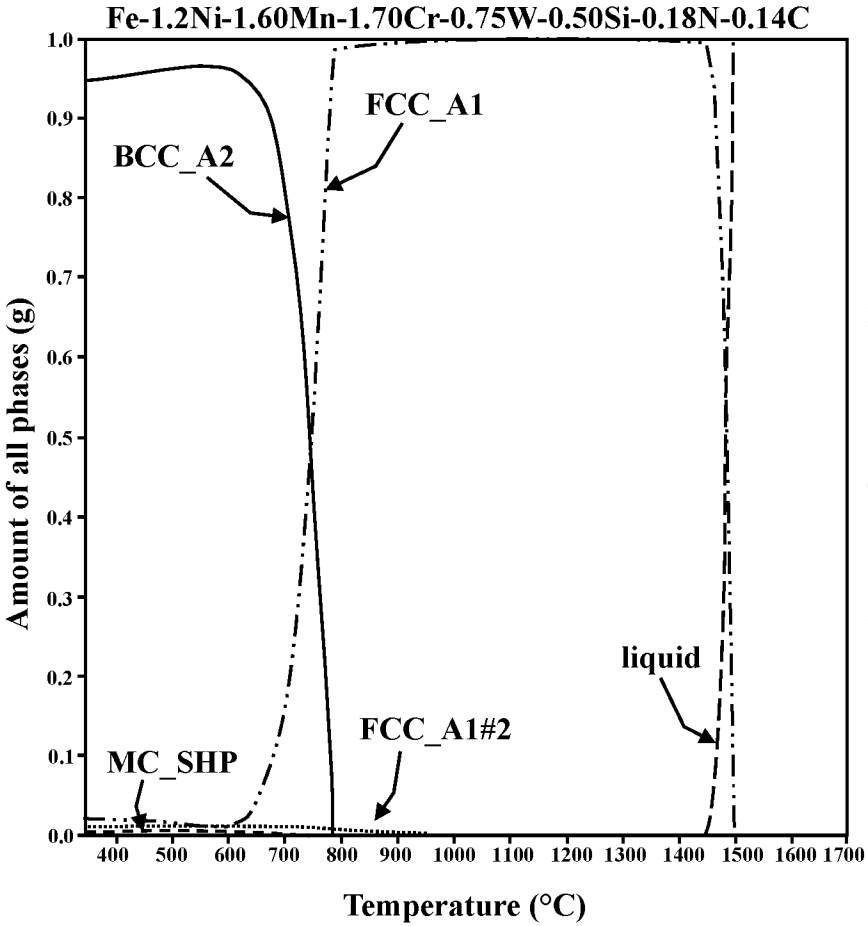
FIG. 2A illustrates a graphical representation of phase versus temperature at 40 bars or 4.0 MPa pressure for an Example Composition 1 according to an embodiment herein.
Figure 2B:
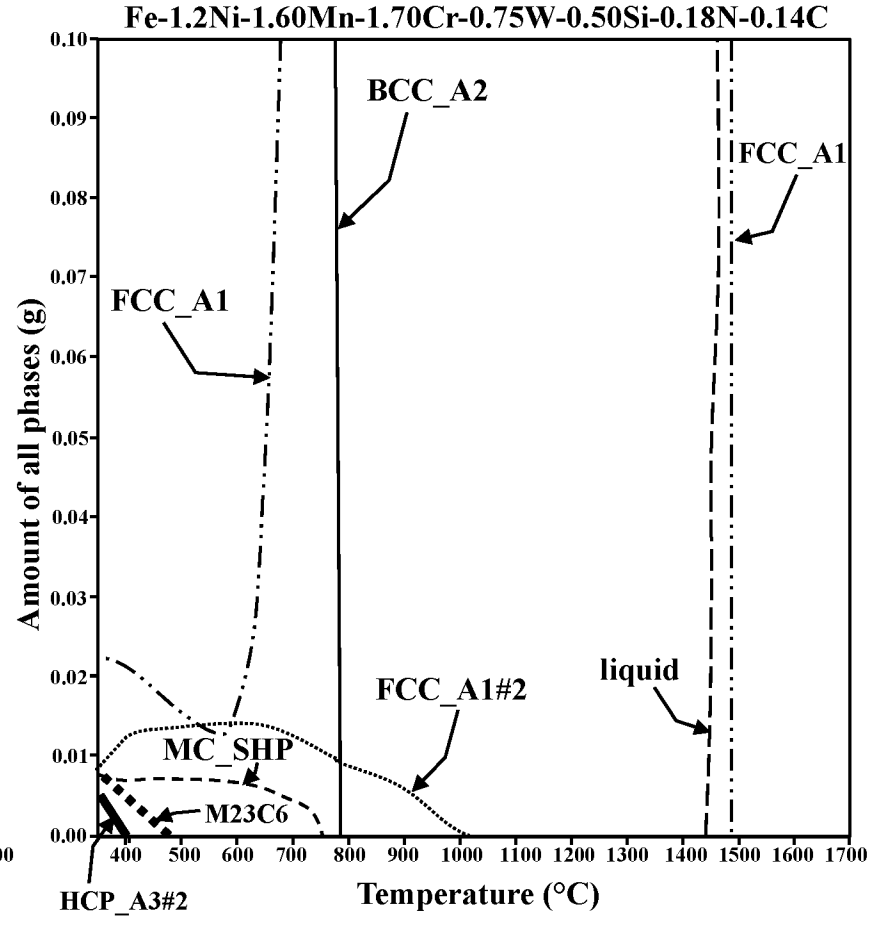
FIG. 2B illustrates the phase versus temperature diagram of FIG. 2A with an expanded scale.

Specific phases which may be present in a system of 1.0 gram are as follows:

FIG. 2A illustrates a graphical representation of phase versus temperature at 40 bars pressure Example Composition 1 of Fe-1.20Ni-1.60Mn-1.70Cr-0.75W-0.50Si-0.18N-0.14C, using a Thermo-Calc model, with 0.0 wt % gas and 0.0 wt % BCC delta ferrite, where the phases are in gram scales of 0 to 1.00 according to an embodiment herein. FIG. 2B illustrates the phase versus temperature diagram of FIG. 2A with an expanded gram scale of 0 to 0.10.

Figure 3A:
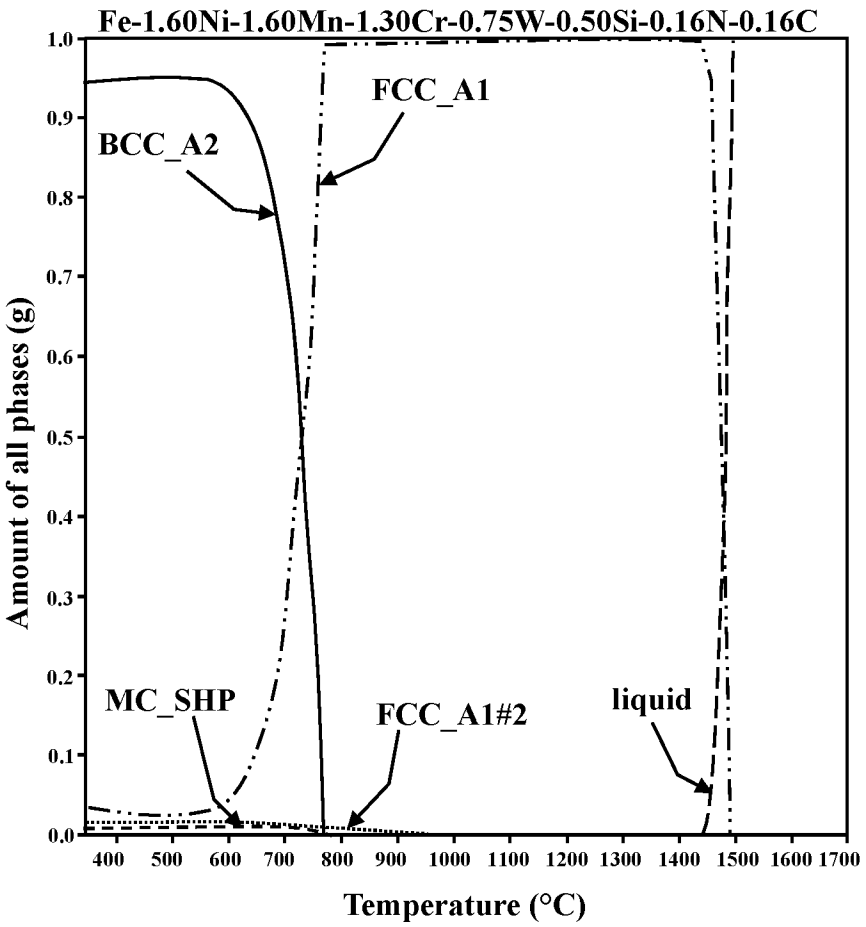
FIG. 3A illustrates a graphical representation of phase versus temperature at 40 bars pressure for another Example Composition 1 according to an embodiment herein.
Figure 3B:
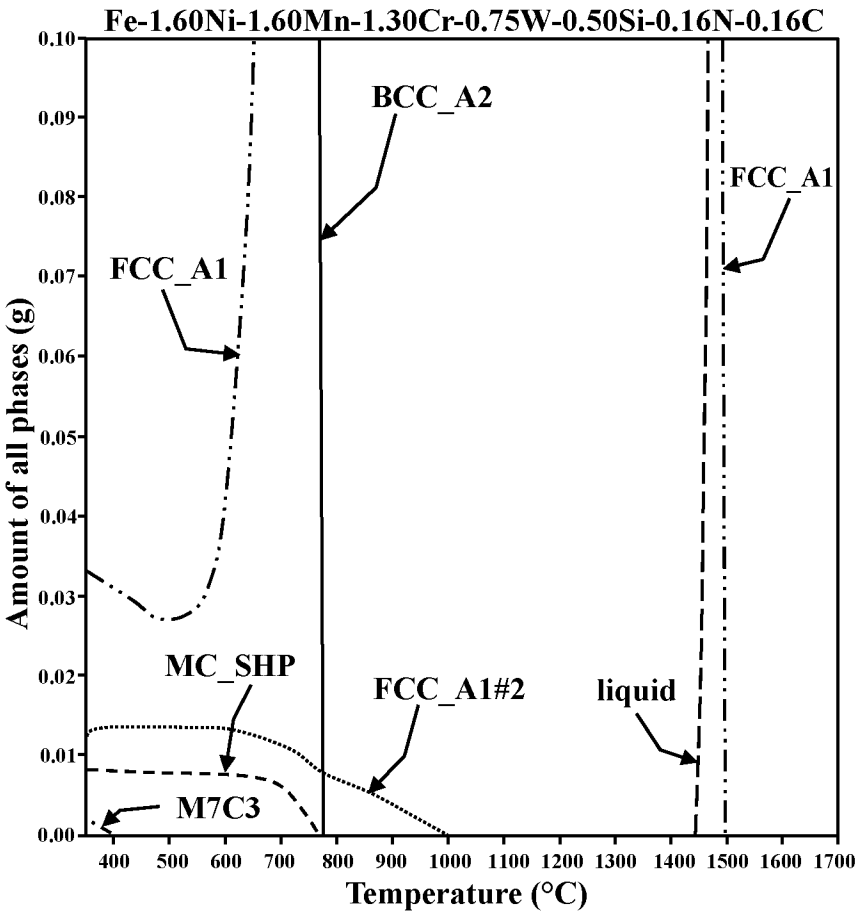
FIG. 3B illustrates the phase versus temperature diagram of FIG. 3A with an expanded scale.

FIG. 3A illustrates a graphical representation of phase versus temperature at 40 bars pressure for second Example Composition 1 of Fe-1.60Ni-1.60Mn-1.30Cr-0.75W-0.50Si-0.16N-0.16C, using a Thermo-Calc model, with 0.0 wt % gas and 0.0 wt % BCC delta ferrite, where the phases are in gram scales of 0 to 1.00 according to an embodiment herein. FIG. 3B illustrates the phase versus temperature diagram of FIG. 3A with an expanded gram scale of 0 to 0.10.

Figure 4A:
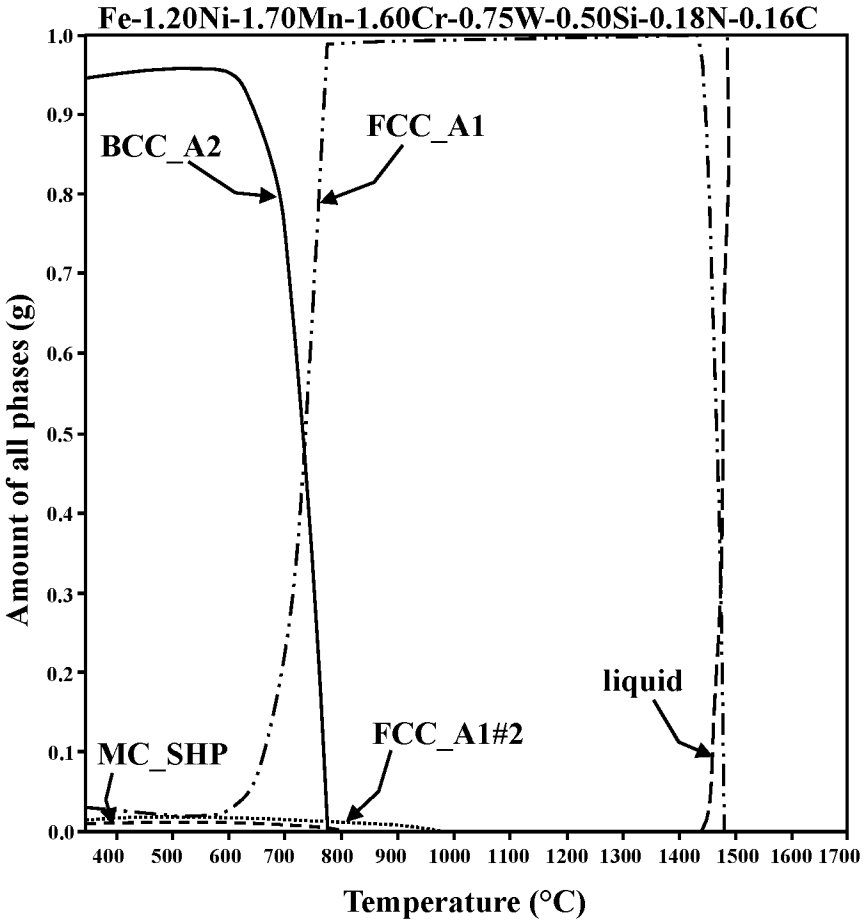
FIG. 4A illustrates a graphical representation of phase versus temperature at 40 bars pressure for a first Example Composition 2 according to an embodiment herein.
Figure 4B:
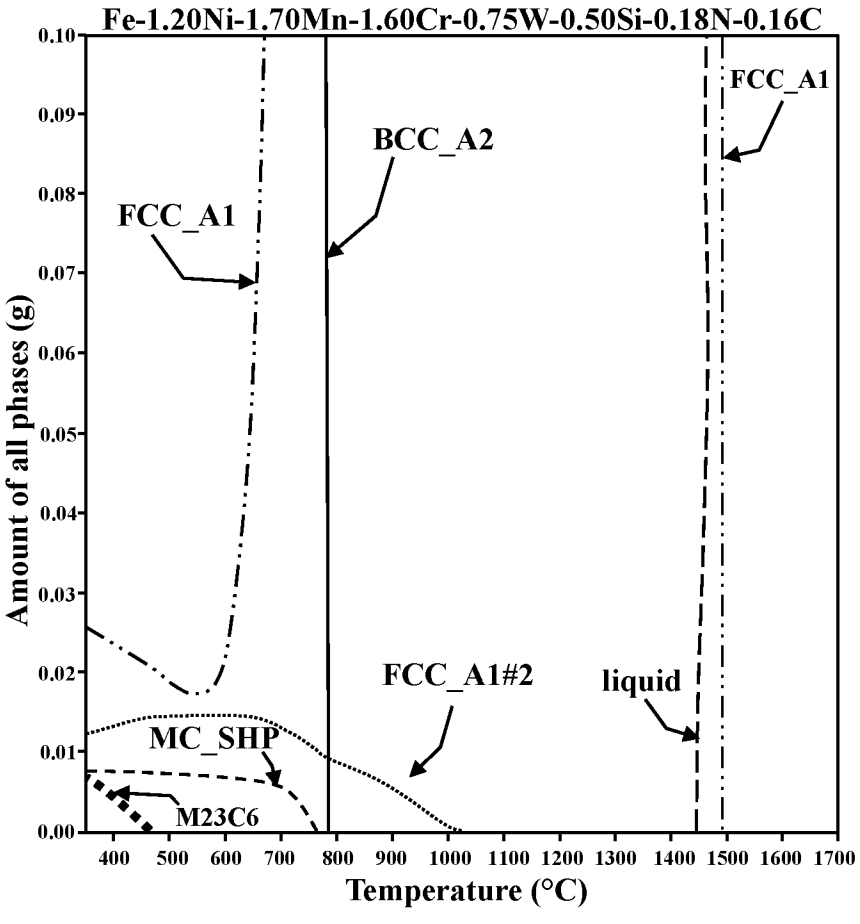
FIG. 4B illustrates the phase versus temperature diagram of FIG. 4A with an expanded scale.

FIG. 4A illustrates a graphical representation of phase versus temperature at 40 bars pressure for a first Example Composition 2 of Fe-1.20Ni-1.70Mn-1.60Cr-0.75W-0.50Si-0.18N-0.16C, using a Thermo-Calc model, with 0.0 wt % gas and 0.0 wt % BCC delta ferrite, where the phases are in gram scales of 0 to 1.00 according to an embodiment herein. FIG. 4B illustrates the phase versus temperature diagram of FIG. 4A with an expanded gram scale of 0 to 0.10.

Figure 5A:
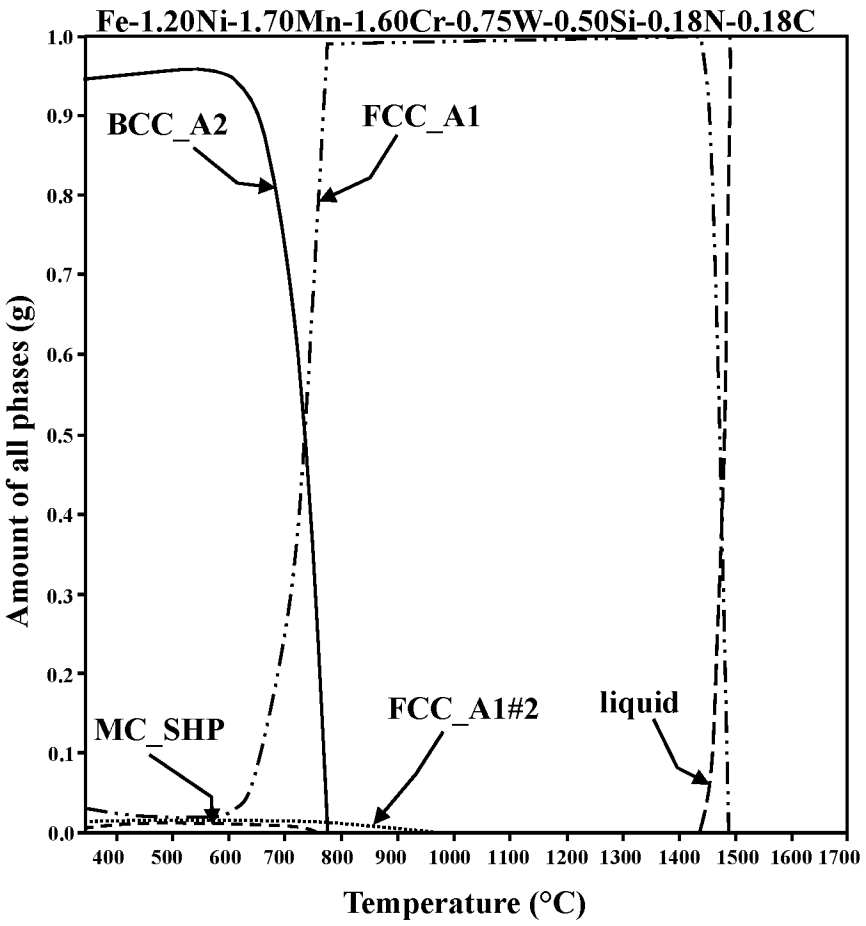
FIG. 5A illustrates a graphical representation of phase versus temperature at 40 bars pressure for a second Example Composition 2 according to an embodiment herein.
Figure 5B:
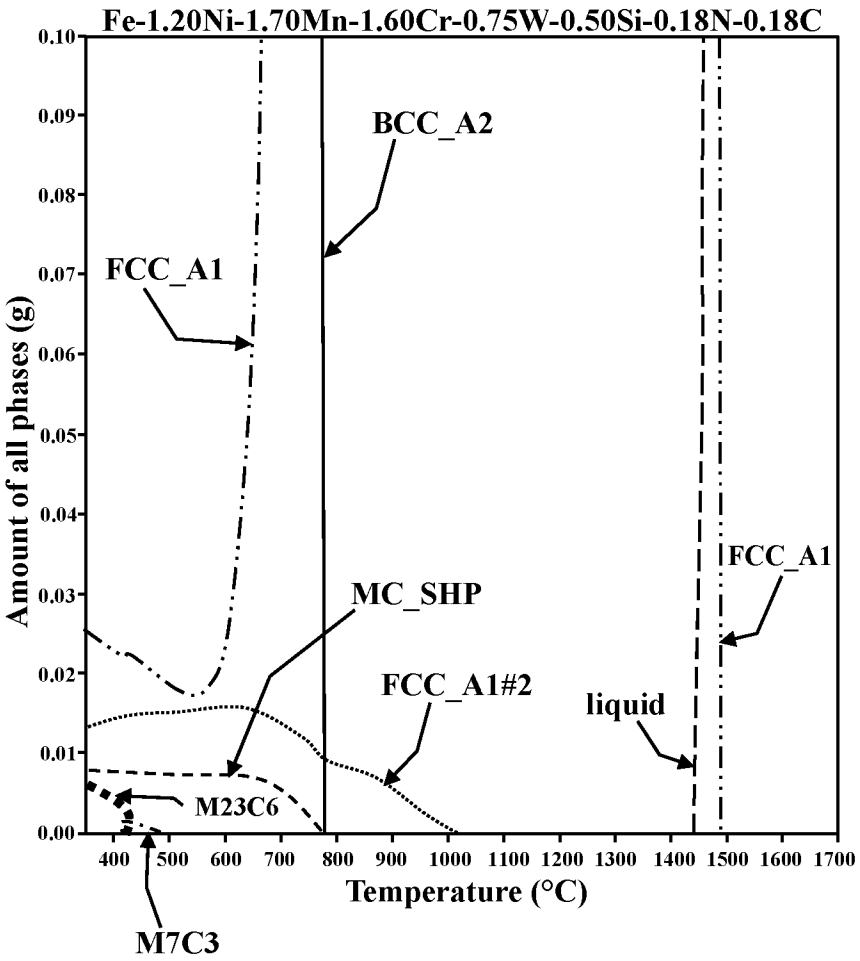
FIG. 5B illustrates the phase versus temperature diagram of FIG. 5A with an expanded scale.

FIG. 5A illustrates a graphical representation of phase versus temperature at 40 bars pressure for a second Example Composition 2 of Fe-1.20Ni-1.70Mn-1.60Cr-0.75W-0.50Si-0.18N-0.18C, using a Thermo-Calc model, with 0.0 wt % gas and 0.0 wt % BCC delta ferrite, where the phases are in gram scales of 0 to 1.00 according to an embodiment herein. FIG. 5B illustrates the phase versus temperature diagram of FIG. 5A with an expanded gram scale of 0 to 0.10.

Figure 6B:
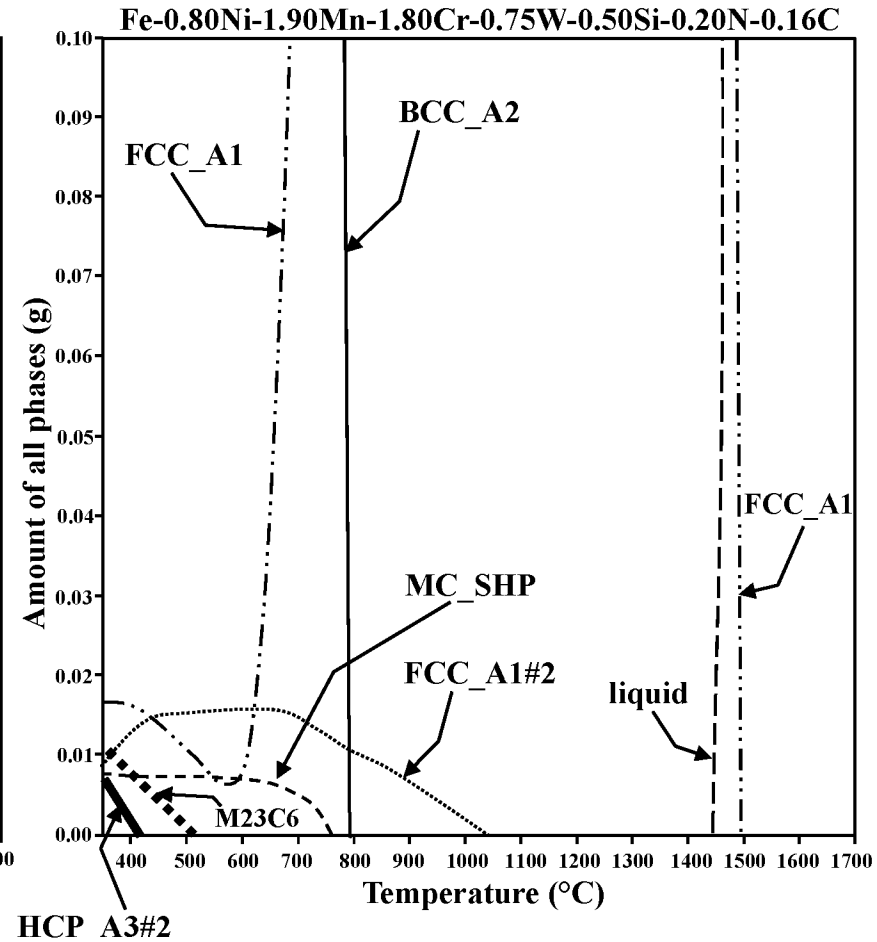
FIG. 6B illustrates the phase versus temperature diagram of FIG. 6A with an expanded scale.
Figure 6A:
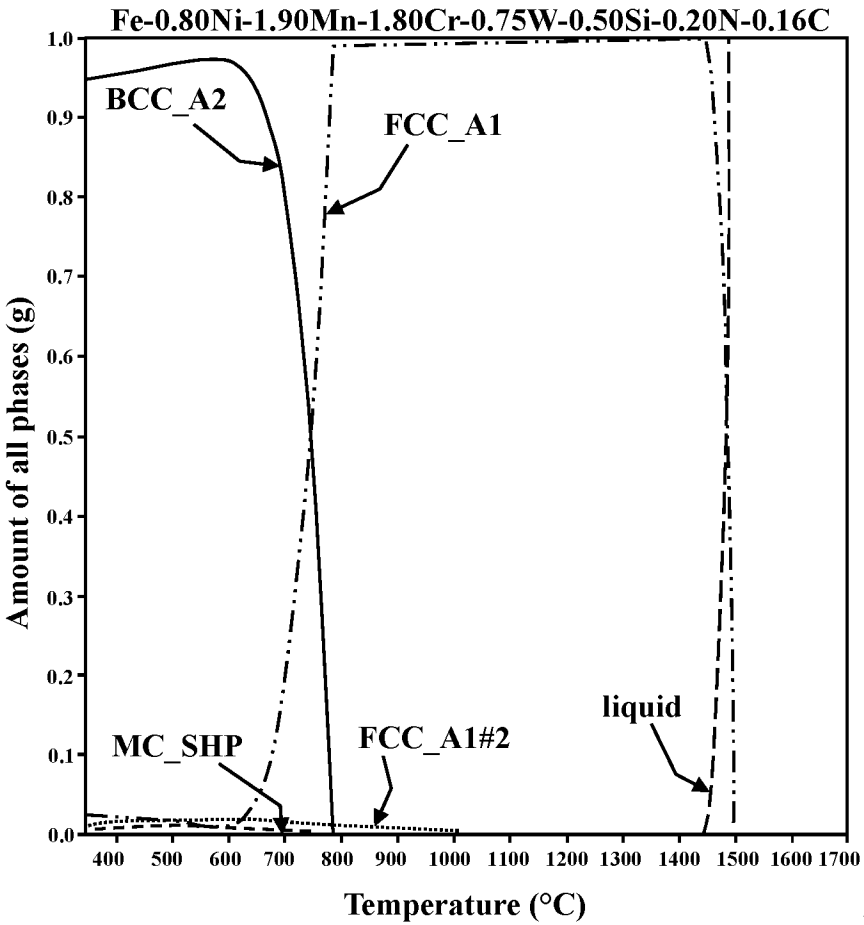
FIG. 6A illustrates a graphical representation of phase versus temperature at 40 bars pressure for a third Example Composition 2 according to an embodiment herein.

FIG. 6A illustrates a graphical representation of phase versus temperature at 40 bars pressure for a third Example Composition 2 of Fe-0.80Ni-1.90Mn-1.80Cr-0.75W-0.50Si- 0.20N-0.16C, using a Thermo-Calc model, with 0.007 wt % gas and 0.0 wt % BCC delta ferrite, where the phases are in gram scales of 0 to 1.00 according to an embodiment herein. FIG. 6B illustrates the phase versus temperature diagram of FIG. 6A with an expanded gram scale of 0 to 0.10.

Figure 7B:
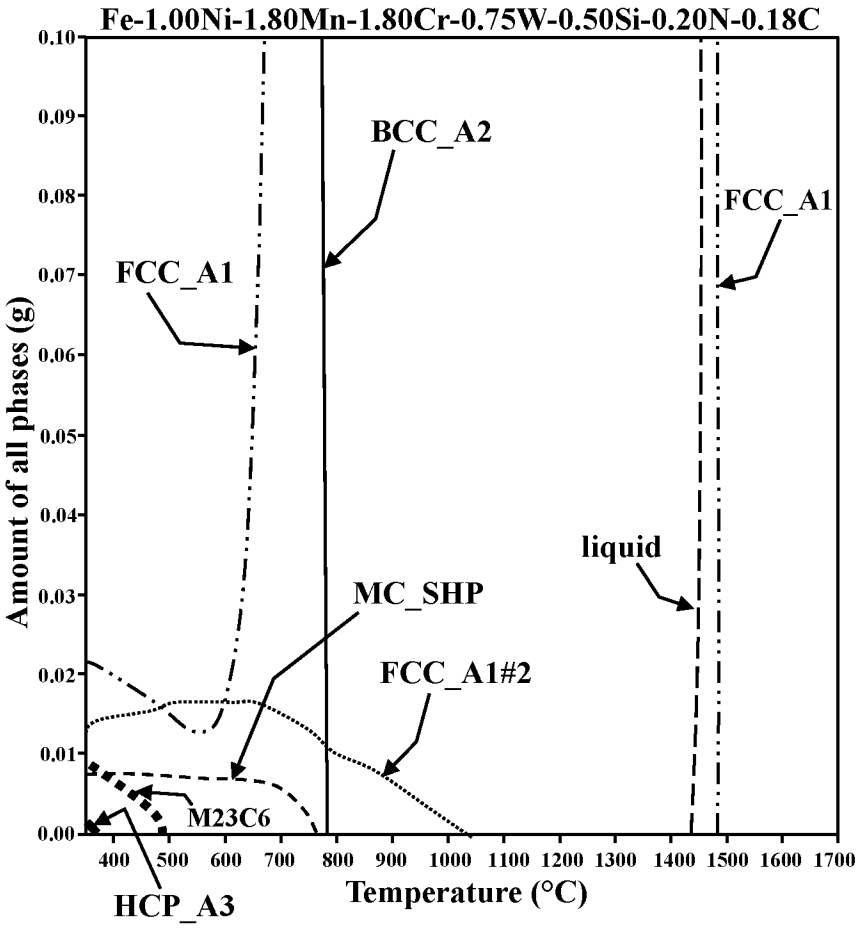
FIG. 7B illustrates the phase versus temperature diagram of FIG. 7A with an expanded scale.
Figure 7A:
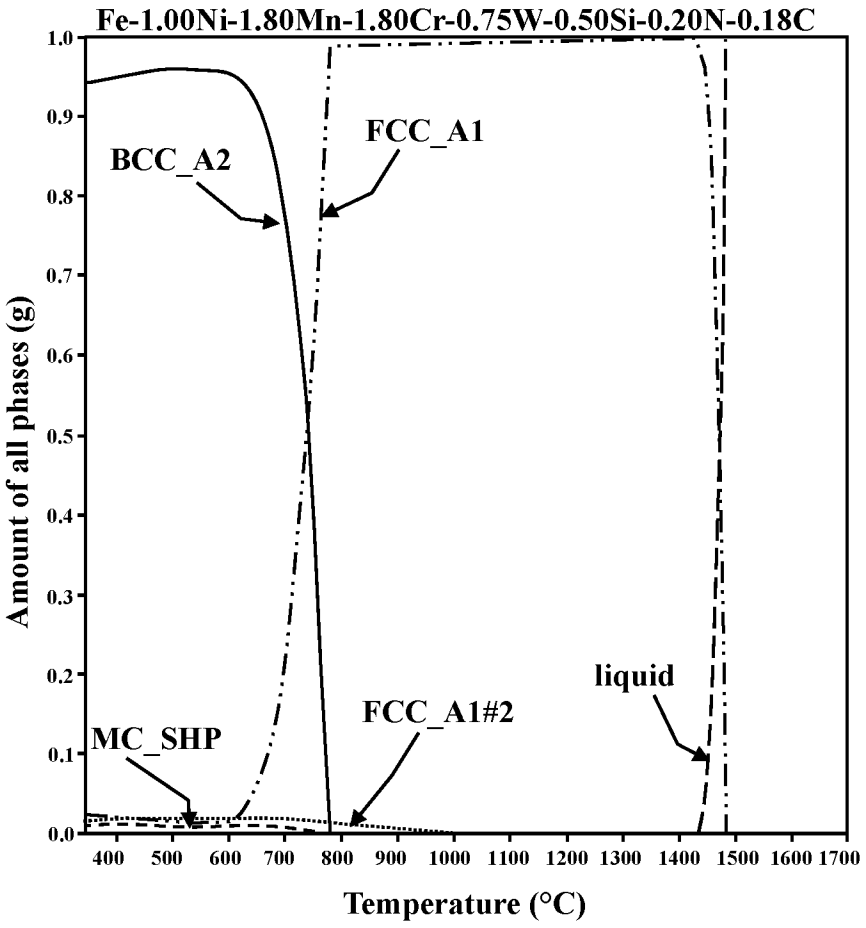
FIG. 7A illustrates a graphical representation of phase versus temperature at 40 bars pressure for a fourth Example Composition 2 according to an embodiment herein.

FIG. 7A illustrates a graphical representation of phase versus temperature at 40 bars pressure for a fourth Example Composition 2 of Fe-1.00Ni-1.80Mn-1.80Cr-0.75W-0.50Si-0.20N-0.18C, using a Thermo-Calc model, with 0.008% gas and 0.0% BCC delta ferrite, where the phases are in gram scales of 0 to 1.00 according to an embodiment herein. FIG. 7B illustrates the phase versus temperature diagram of FIG. 7A with an expanded gram scale of 0 to 0.10.

Figure 8B:
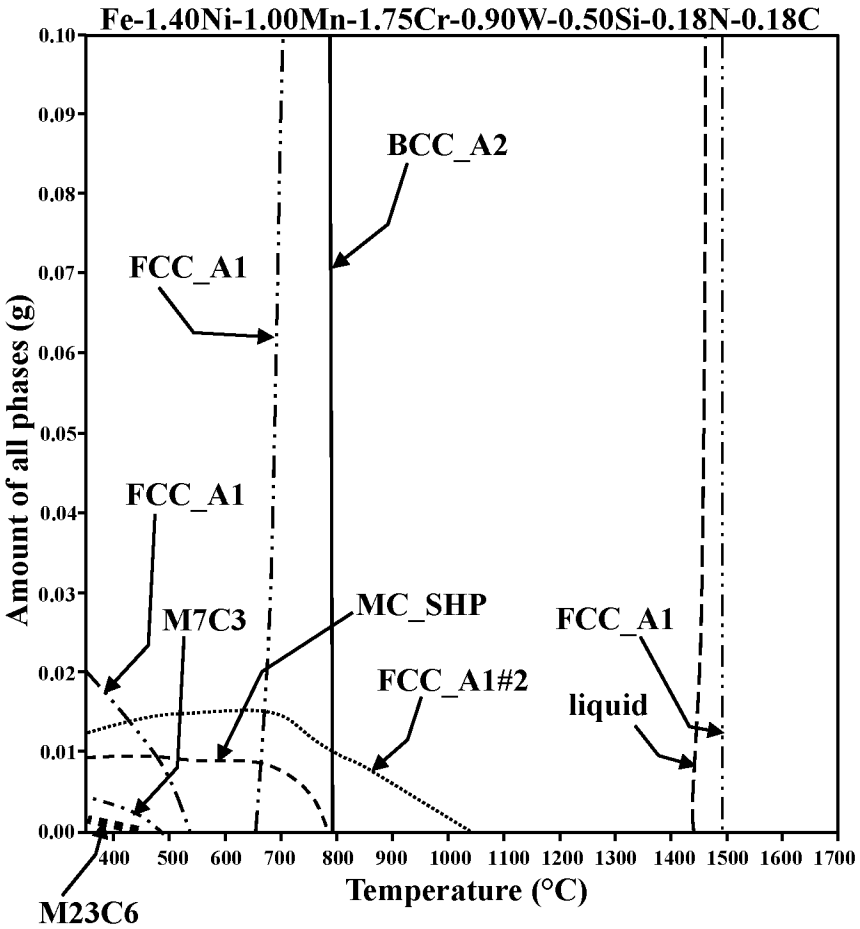
FIG. 8B illustrates the phase versus temperature diagram of FIG. 8A with an expanded scale.
Figure 8A:
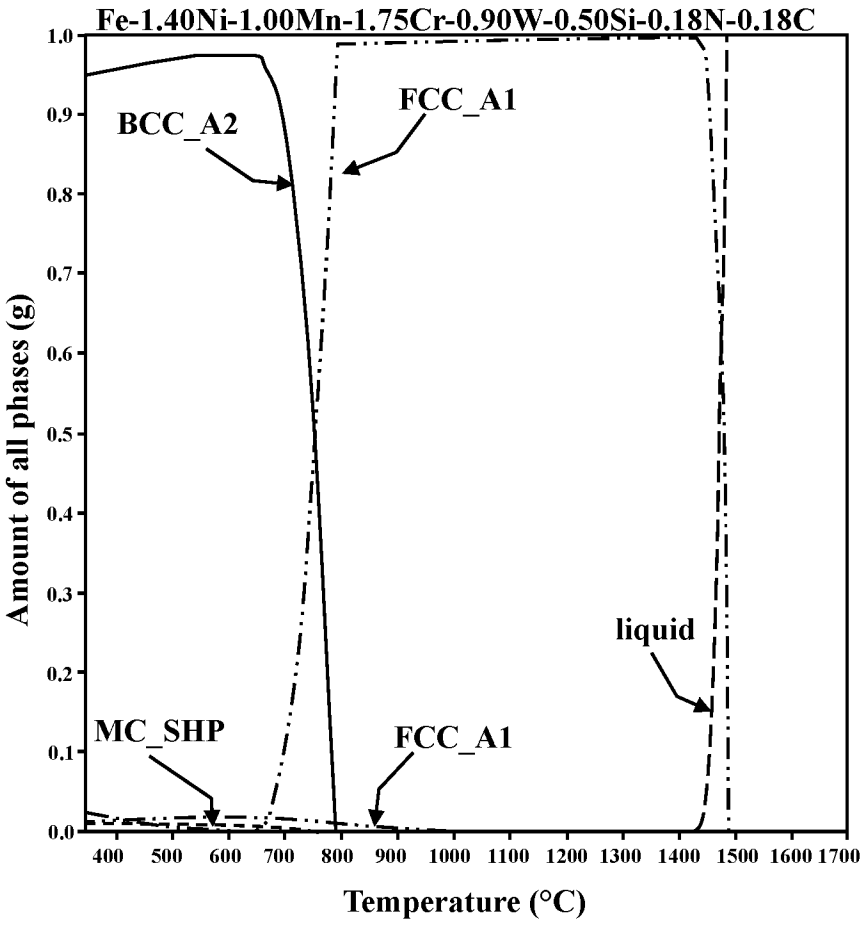
FIG. 8A illustrates a graphical representation of phase versus temperature at 40 bars pressure for an Example Composition 3 according to an embodiment herein.

FIG. 8A illustrates a graphical representation of phase versus temperature at 40 bars pressure for an Example Composition 3 of Fe-1.40Ni-1.00Mn-1.75Cr-0.90W-0.50Si-0.18N-0.18C, using a Thermo-Calc model, with 0.002 wt % gas and 0.0 wt % BCC delta ferrite, where the phases are in gram scales of 0 to 1.00 according to an embodiment herein. FIG. 8B illustrates the phase versus temperature diagram of FIG. 8A with an expanded gram scale of 0 to 0.10.

Figure 9A:
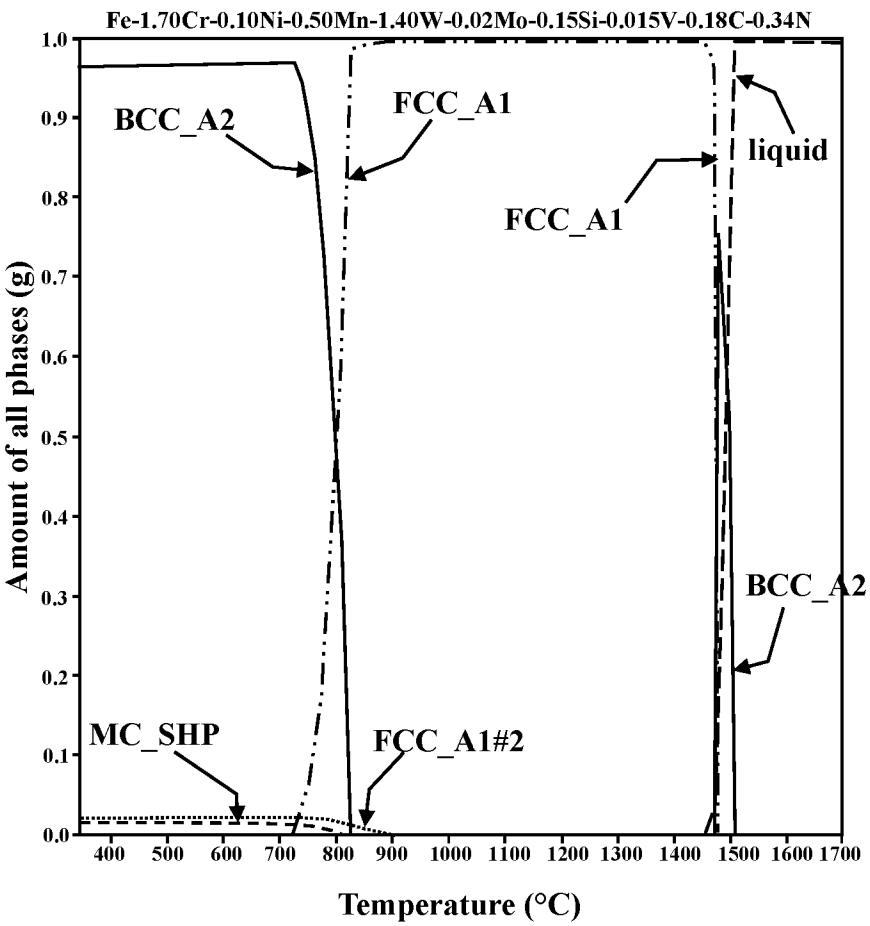
FIG. 9A illustrates a graphical representation of phase versus temperature at 1 bar pressure for an Example Composition 4 according to an embodiment herein.
Figure 9B:
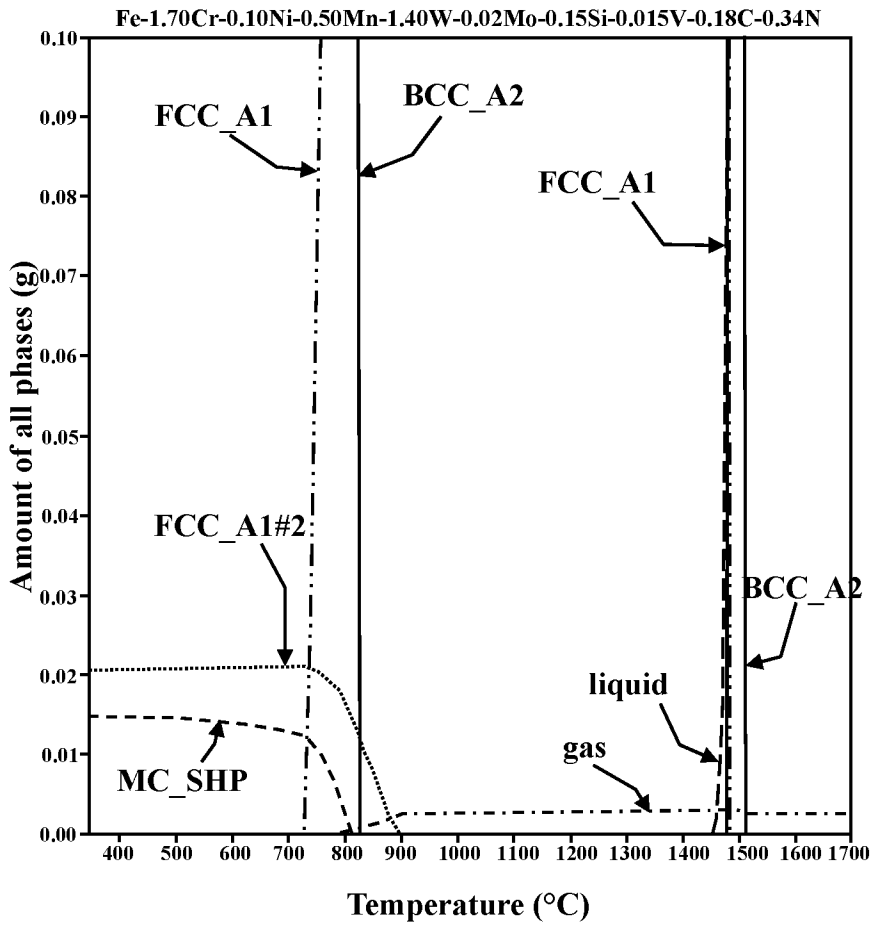
FIG. 9B illustrates the phase versus temperature diagram of FIG. 9A with an expanded scale.
Figure 9C:
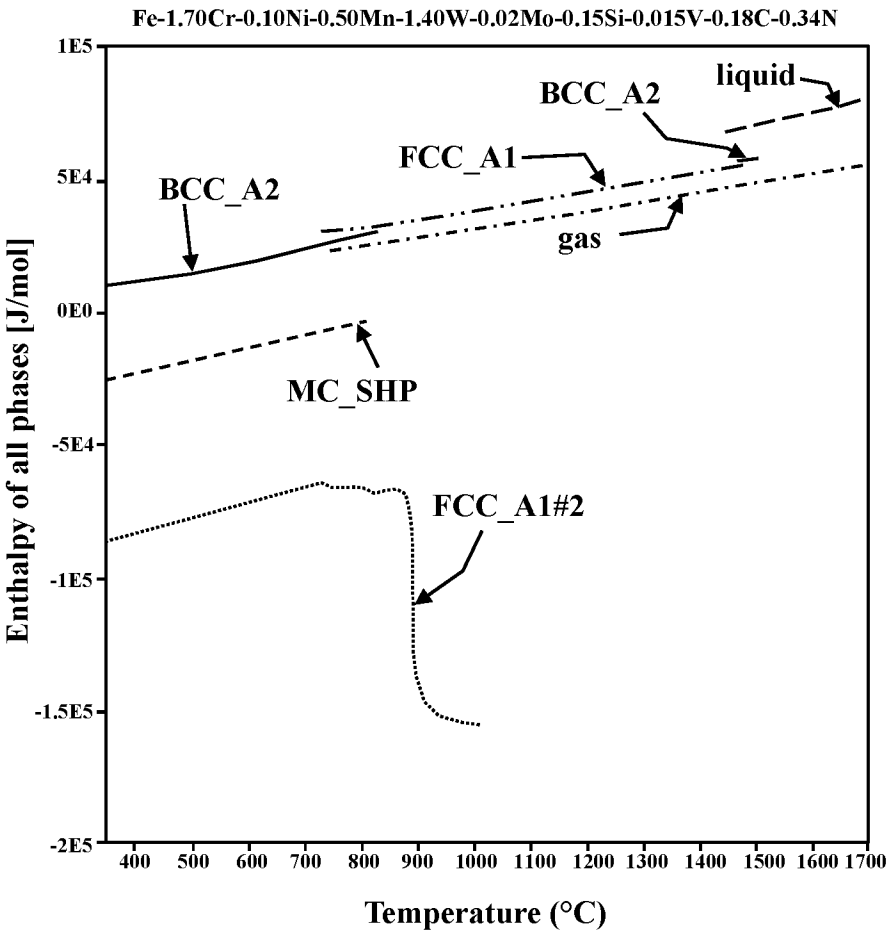
FIG. 9C illustrates the phase enthalpy versus temperature diagram for same Example Composition 4 and 1 bar pressure of FIGS. 9A and 9B.

FIG. 9A illustrates a graphical representation of phase versus temperature at 1 bar pressure for an Example Composition 4 of Fe-0.10Ni-0.50Mn-1.70Cr-1.40W-0.15Si-0.34N-0.18C, using a Thermo-Calc model, where the phases are in gram scales of 0 to 1.00 according to an embodiment herein. FIG. 9B illustrates the phase versus temperature diagram of FIG. 9A with an expanded gram scale of 0 to 0.10. FIG. 9C illustrates the phase enthalpy versus temperature diagram at 1 bar pressure for same Example Composition 4 of FIG. 9A and FIG. 9B.

Figure 10:
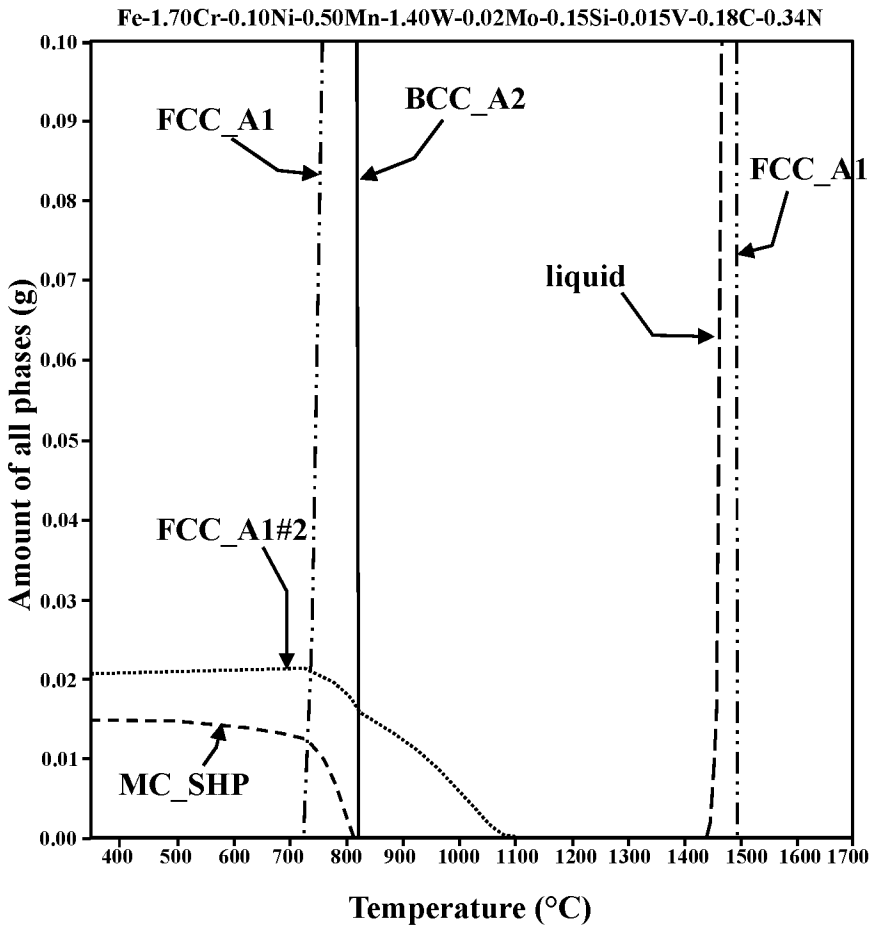
FIG. 10 illustrates a graphical representation of phase versus temperature plot at 140 bars pressure for the same Example Composition 4 of FIGS. 9A through 9C.

FIG. 10 illustrates a graphical representation of phase versus temperature plot at 140 bars pressure with an expanded gram scale of 0 to 0.10 for the same Example Composition 4 of FIG. 9A-9C, revealing complete absence of nitrogen gas and delta ferrite over temperatures of solid or liquid phases.

Figure 11A:
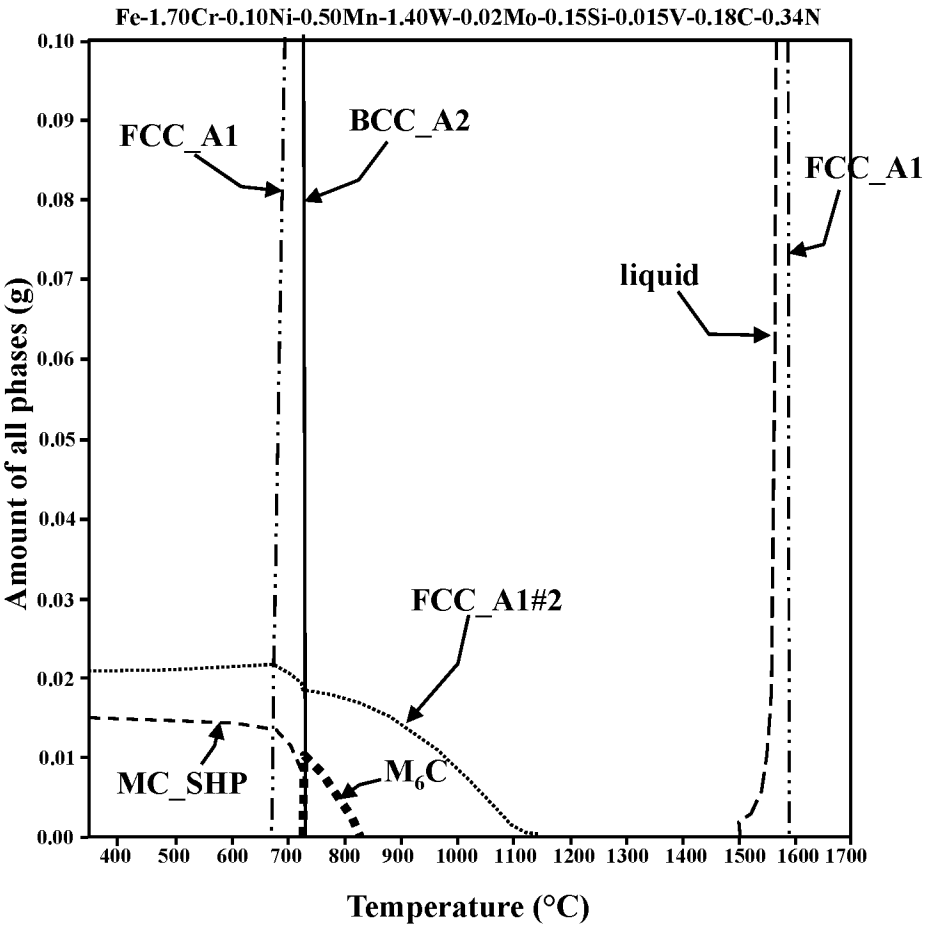
FIG. 11A illustrates a graphical representation of phase versus temperature at 20,684 bars pressure for the same Example Composition 4, where the phases are in expanded gram scales of 0 to 0.10.

FIG. 11A illustrates a graphical representation in an expanded gram scale of 0 to 0.10 of phase versus temperature at 20,684 bars pressure for the same Example Composition 4, where the durability of MC_SHP hardening phase and FCC_A1#2 toughening phase are revealed at elevated pressures and at temperature less than 727° C.

Figure 11B:
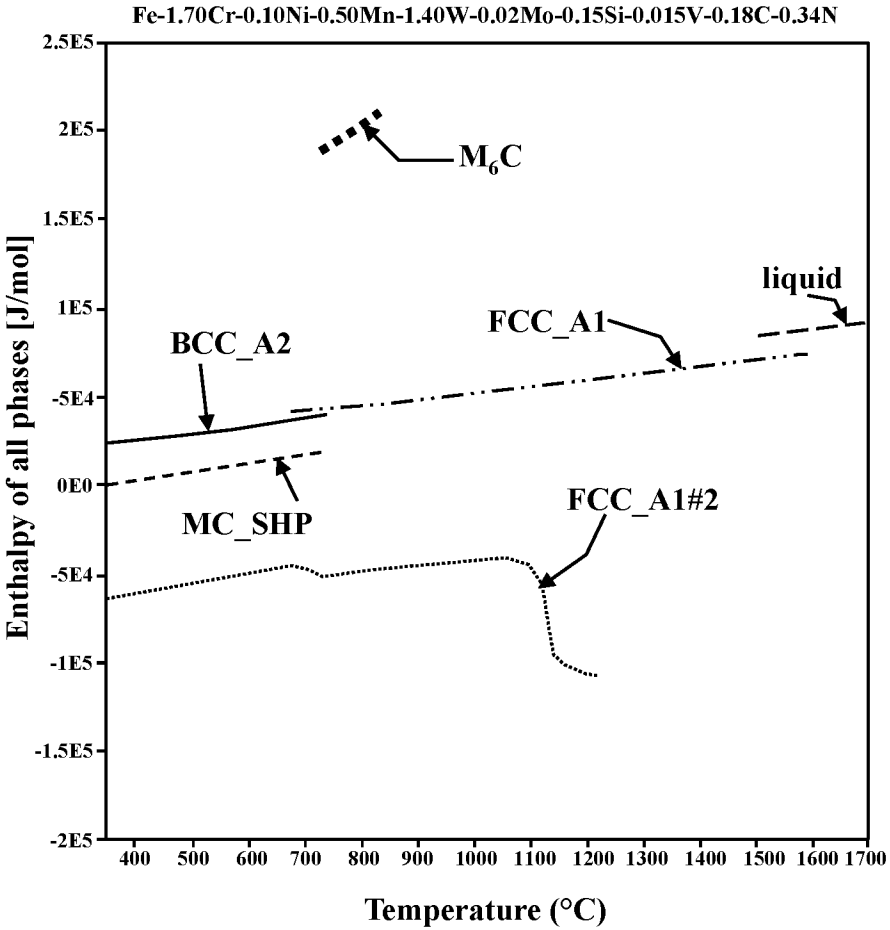
FIG. 11B illustrates a diagram of the enthalpy of all phases in joules/mole (J/mol) versus temperature at 20,684 bars pressure for the same Example 4 Composition of FIGS. 9A through 9C, and same temperature, and pressure of FIG. 11A.

FIG. 11B illustrates a diagram of the enthalpy of all phases in joules/mole (J/mol) versus temperature at 20,684 bars pressure for the same Example 4 Composition, temperature, and pressure of FIG. 11A, which reveals that the durability and enthalpy strength of MC_SHP hardening phase and FCC_A1#2 toughening phase less than 727° C. are stronger than the BCC_A2 and FCC_A1 matrices.

Results of the Thermo-Calc model property diagrams of FIGS. 2A through 8B demonstrate that a more uniform distribution of the alloy constituents in the steels may be obtained by pressure remelt or cast metallurgy approach followed by austenitization, quenching, and hardening; for example, tempering in a temperature range from about 460° C. to about 650° C. Furthermore, consecutive tempers and quenches may be used to lower the level of retained austenite to increase hardness.

Embodiments herein of the low alloy high nitrogen steel can provide characteristics in compositions and processes specific for combined high strength and toughness as a low cost low alloy steel. These embodiments can be obtained by N alloying and PESR processing, adequate levels and ratios of N plus C with Mn, Cr, and W to achieve high levels of strength, beneficial microstructure which may include tempered martensite and controlled shape of any S, and durability with toughness and resistance to stress corrosion at high levels of strength where typical high strength carbon steels are susceptible to stress corrosion or low toughness.

Other embodiments can include compositions with W, high Mn with low-moderate Ni, and balanced C plus N, provide increased near ideal phases, for example, low to minimal delta ferrite less than around 28 wt % during solidification for low to minimal or no N de-gassing during and immediately following solidification. At process temperatures of about 460° C. to about 650° C., or lower these embodiments provide an ability to dissolve or preclude deleterious weak embrittling carbides or nitrides and P intermetallic compounds.

In some embodiments including compositions with 0.60 to 2.00 Mn, N solubility can be enhanced in liquid and with relatively low levels of Ni. This can enable fewer tendencies for N to de-gas immediately following solidification and at high temperatures in the austenitic region.

The high Mn+N compositions of some embodiments provides an effect to substitute for Ni and enhances N solubility in liquid to solid transitions for alloys by inhibiting delta ferrite without an excess effect to form carbide at low temperatures such as with Cr. That is, carbides for example $M_{23}C_6$, are inhibited from forming at low temperatures according to these embodiments. In the high Mn alloys, a small amount of Co may be used to adjust the BCC to FCC lattice transition temperature.

Embodiments herein including a W constituent in a 0.45 to 1.5 percent range can provide a composition and a process in service to retain strength and toughness by resisting and precluding the weakening and failure processes typical of carbon austenite FCC and carbon ferritic BCC hardening C precipitates and matrices at ambient and at high temperatures and pressures as shown by the Thermo-Calc model up to 20.684-27.579 kbar (300-400 ksi) pressure by WCN hardening phase enthalpy more negative than the matrix. Ordinarily, in carbon steel, Mo and W solutes are difficult to solutionize throughout process temperatures in steel, in contrast, the steel alloys of the embodiments herein having C—N compositions as described, enhance solubility of W and the alloy constituents Cr, Mn, and N.

These embodiments provide a unique Mn and balanced C and N constituents in low alloy high nitrogen steel, which can allow a greater window of Cr composition and process than Ni, for example, to provide fewer tendencies for N to de-gas immediately following solidification and at high temperatures in the austenitic region. With adequate amounts of N, the range of tempered martensite embrittlement may be lessened, and a greater process window of temper temperatures may be achieved.

These embodiments provide low Ni by substitution of Mn combined with N for low cost, and a more stable alloy under high pressure with minimal reversion to austenite, and for more conversion to strengthening by martensite during quench hardening, than, for example, the known low alloy carbon steels. Savings of expensive Co and Ni are attained over high alloy secondary hardening steels.

The compositions and processes provided by the embodiments herein dissolve deleterious weak, embrittling $Fe_3C$ or $Fe_3CN$ cementite, or higher order carbides, for example, $M_7C_3$, $M_{23}C_6$, and the like, that deplete the matrix of hardening and corrosion protective Cr and Mo, and substitute after austenitization, quench, and temper a more homogeneous distributed MC_SHP phase which provides a hardening contribution.

According to the embodiments herein, with qualities of good fluidity, the low alloy compositions with Mn and Ni constituents and melting/casting under N or N—Ar pressure promote capability for casting to shape by squeeze casting or pressure casting methods. For example, during solidification and cooling of solid metal, the compositions of controlled low amounts of delta ferrite or 0% delta ferrite and 0%-0.008% gas at 40 bars pressure can promote high resistance or immunity to both gas evolution and porosity. The low alloy content balanced in levels of Cr, W, Mn, C, and N can prevent clustering and precipitation of massive carbides and nitrides common in high alloy or higher Cr level compositions. Furthermore, pressure of the casting during solidification may be raised above the melt temperature to lower hazards or to enhance the level of N and lower the amount of delta ferrite.

For wrought products, according to the embodiments herein, the PESR method with N can provide improved characteristics over alternative melt processes and simple N-pressure casting, by obtaining a high level of N solution into liquid and solid, high ingot quality through removal of and shape control of S, dispersion of any oxides into small dispersed round shapes, and a refined dendrite structure with minimal segregation. Large production volumes may be obtained as ingots according to these embodiments. Inclusion of clean metal practices, for example, VIM/VAR, nitrogen/argon refining, to produce electrodes for the PESR process or squeeze casting can provide additional characteristics in toughness and resistance to stress corrosion.

FIG. 9A illustrates an Example Composition 4, Fe-1.70Cr-0.10Ni-1.40W-0.50Mn-0.15Si-0.18C-0.34N solid state manufacture alloy with a graphical plot representation of phase versus temperature at 1 bar pressure and in gram scales of 0 to 1.00 of a 1 gram system according to an embodiment herein. FIG. 9B illustrates the phase versus temperature diagram of FIG. 9A with an expanded scale of 0 to 0.10. FIG. 9C illustrates the enthalpy versus temperature diagram at 1 bar pressure of same Example Composition 4. The composition with 0.34% N shown in FIG. 9A illustrates the complete absence of the cementite phase, and complete absence of any gas phase over a range of 350° C. to around 800° C., and the capability for manufacture by solid state gas-solid processing. The enthalpy versus temperature diagram FIG. 9C illustrates that strengthening and toughening phase MC_SHP, or WCN, and the FCC_A1#2 phase have greater bond strength than either the matrix FCC or BCC phases over a wide range of temperature of 350° C. to 800° C., which supports capability of strength, ductility, durability, and toughness.

FIG. 10 illustrates a graphical representation of phase versus temperature for a 1 gram system of same Example Composition 4 of Fe-1.70Cr-0.10Ni-1.40W-0.50Mn-0.15Si-0.18C-0.34N but at 140 bars or 14.0 MPa pressure, using a Thermo-Calc model, where the phases are in expanded gram scales of 0 to 0.10 according to an embodiment herein. The phase versus temperature plot at 140 bars reveals that for all temperatures, delta ferrite is suppressed, and nitrogen gas is suppressed, far below the 1000 MPa to 1500 MPa pressures of available conventional hot isostatic pressing (HIP) consolidation process facilities for steel. FIG. 10 reveals the capability for solid state alloy and consolidation manufacture processes at high temperatures.

FIG. 11A illustrates a graphical representation of phase versus temperature for 1 gram system with the same Example Composition 4 of Fe-1.70Cr-0.10Ni-1.40W-0.50Mn-0.15Si-0.18C-0.34N but with a plot at 20,684 bars pressure and in expanded gram scales of 0 to 0.10, using a Thermo-Calc model, according to an embodiment herein. FIG. 11B illustrates a diagram of the enthalpy of all phases at 20,684 bars pressure in joules/mole (J/mol) versus temperature for the Example Composition 4 alloy phases of FIG. 11A.

FIGS. 9B, 9C, 11A, and 11B reveal the phase strength both at ambient pressure with 1 bars (14.5 lbs./square-inch) and dynamic load level of pressure of 20,684 bars (299,997 lbs./square-inch) for a low nickel, low manganese alloy. At near ambient process, and dynamic load levels of pressure, the hardening MC_SHP phase, here specifically WCN is maintained, and the WCN strength is maintained with a greater negative value of enthalpy than either the BCC or FCC matrix constituents. Furthermore, the BCC to FCC transformation is relatively stable and remains high in transition temperature than that of high manganese-nickel alloys.

According to an embodiment herein, alloying nitrogen with a solid state metallurgy process approach either by mechanical alloying and gas-solid adsorption, or by surface gas-solid state N diffusion eliminates concerns of deleterious effects of N solubility from solidification phases at high temperature and allows greater levels of C, N, Cr, and W content limited only by the onset of cementite formation. The higher level of N, Cr, and W may provide greater strength, toughness, and corrosion resistance. Over the temperature range of up to around 800° C., the solid state manufacture of compositions provided by the embodiments herein allow 0.60 wt % N before onset of $Fe_3CN$ cementite or N gas. The typical limit of N will be limited by need for a specific level of ductility and toughness. Around 840° C. to 900° C. moderate levels of pressure are required for solid state alloying of N, for example 120-180 bars or 12-18 MPa, and under these elevated temperatures and pressures, the alloying may occur at a more rapid rate.

The compositions and processes provided by the embodiments herein have characteristics to optimize beneficial metallic, mechanical, and thermodynamic properties and effects of N in low alloy steel to help to resist fracture and fracture instability, improve plastic flow, strength, ductility, toughness, and resistance to corrosion and stress corrosion cracking (SCC). The specific low alloy high nitrogen steel embodiments cover a range of compositions in classes of high and ultra-high strength steels, and can minimize or eliminate in each class, over a wide and useful range of temperatures and time the deleterious precipitation or partitioning of C and solutes into carbide phases and minimize matrix depletion of solute Cr and W. Furthermore, the embodiments can enhance beneficial, more ideally metallic-like, short range ordered, yet a high entropy distribution of alloy solutes and low enthalpy strong N and N—C phases which can be ideally compatible for hardening and strengthening by methods of austenitizing, quenching, hardening, and temper hardening by extending the range without tempered martensite embrittlement.

The embodiments have compositions of both high and enhanced N levels and high and enhanced Cr levels, and high W levels for the greatest levels of strength and resistance to corrosion, while meeting design objectives of avoidance of the deleterious carbides $M_{23}C_6$, $Fe_3C$ cementite, or $M_7C_3$, or graphite.

Alloys of the embodiments herein can enable characteristics of a quench and temper low alloy martensitic steel strengthened by austenitizing and quench, then low temperature tempering or elevated temperature secondary hardening. The steels of the embodiments can have specific compositions and ratios of alloy elements directed over a broad range of compositions and strength specifically to optimize the characteristics of N, and N with C in steel, and to minimize or exclude deleterious cluster effects of C with solute atoms Cr, Mo, W, and Mn in steel. The applications of these low alloy steels may be in the fields of aerospace, defense, industry, petrochemical, structure shapes, vehicles, machinery, and protection structures.

The characteristics of these embodiments can include a combination of features described herein. Foremost, the embodiments provide high levels of strength following tempering at low and high ranges of temperature. Furthermore, the low alloy steel compositions and processes of a wide range of compositions can minimize or eliminate, over useful and wide ranges of temperatures and time, deleterious amounts and shape of S constituents, and precipitation or partitioning of carbide phases and matrix depletion of solute C, Cr, and W, whether during manufacture, processing, fabrication, or joining. Also, the embodiments provide quench and tempered martensitic steel with low sensitivity to quench rate from absence of cementite or carbides. The embodiments provide low alloy compositions and processes which can enhance beneficial, more homogeneous microstructure, and more ideally metallic-like distribution of alloy solutes and N and C and their associated phases and which are ideally capable for processing by methods of austenitizing, quenching, hardening and most specifically, secondary hardening.

Additional characteristics of embodiments include compositions amendable to casting that may attain high levels of N, and variable levels of C, for example, for example, 0.14 to 0.22 weight percent N or C with N/C weight ratio of 0.85 to 1.3, a Cr/C ratio of 12 to 8, Mn as necessary for conversion of FeS to MnS intermetallic, to assist control of delta ferrite and to minimize outgas from high temperature austenite, and to help to achieve the greatest hardness. The compositions include sufficient, but not excessive, levels of Cr, Mn, Mo, W, substitutional solutes to enhance solubility of C and N in solid state solution and of N in liquid steel under pressure to levels upward of 0.14-0.22 (wt %) N, as predicted by Sievert's Law or Cr level equivalents and interaction parameters of elements with N in Fe. With compositions of high levels of Mn, for example 1.80 wt %, substitution of Ni with less than 1.00 wt % Co and lessening adjustment of Cr or Mn provides benefits by increasing the BCC to FCC transition temperature on heating without great adverse effects on delta ferrite levels.

Characteristics of embodiments achieved by the alloy solid state solution are N solubility levels upwards to 0.60 wt % before onset of cementite or at 1 bar, N gas. The C, N, and substitutional solutes assist strengthening with MC_SHP WCN and ordered phases that do not deplete the matrix from formation of complex carbides of Fe, Cr, and W. The compositions of the embodiments herein provide primarily all martensitic structure, and not austenite or ferrite from prediction of a Schaeffler diagram, following austenitizing and quench through Ni-equivalent contributions of Ni, Mn, Co, N, and C, and the Cr-equivalent parameters of Cr, Mo, W, and Si. The solid state alloys may have enhanced Cr, W, N, and C and may have low levels of Si, Ni, and Mn. The low levels of Mn and Ni, high N, and low to moderate C allow maintaining the lower BCC to FCC transition temperature up to 780° C.

The compositions provided by the embodiments herein achieve characteristics, through modeling and a design method of computational materials engineering that are realized by property diagrams of phase amounts versus temperature, and thermodynamic parameters of enthalpy, entropy, and Gibbs energy per formula unit versus temperature. The compositions are consistently directed to optimize N benefits and achieve characteristics over conventional C-steels, high alloy steels, or the high nitrogen steels (HNS's) that may not be of optimal compositions.

Aspects of the embodiments herein include steel alloys that can eliminate, during processing phase transformation or precipitation, detrimental partitioning of carbides to grain boundaries, or upon transformation of constituent phases, the coarsening and excessive segregation of alloy elements to precipitates. This can lead to austenitizing at lower temperatures than typical for coarse high stability nitrides or carbides. Strengthening methods of hardening of these alloys yield improved microstructure and properties of strength, ductility, and toughness, and resistance to corrosion and stress corrosion, all without reliance on high levels of relatively expensive nickel and cobalt such as used in aerospace alloys AF1410 and Aermet 100.

Aspects of the embodiments herein also include steel alloys which can be predicted to have under conditions of ballistic impact, for example, 20-50 kbar pressure, to have improved resistance to thermal softening or microcracking through equilibrium phases that retain high strength (enthalpy) and thermodynamic stability (Gibbs energy) relative to the matrix from the enhanced contributions of enthalpy and entropy over a wide range of temperature; and absence of carbides which may lose strength under pressure and temperature, form voids or initiate and localize deformation under pressure or during plastic flow. In cast alloys, either restricting levels of Mn or Ni to less than around 0.80 wt % each, or adding a small amount of Co in place of Ni in the high Mn level alloys can provide resistance to softening by maintaining the temperature and restricting the amount BCC to FCC transition. The solid state alloyed compositions may better restrict Mn, Ni, and C to maintain the BCC to FCC transition temperature to high levels up to 780° C.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A low alloy high nitrogen steel comprising iron and, by weight:

0.14-0.60% nitrogen (N);
0.08-0.28% carbon (C);
0.10-2.20% nickel (Ni);
0.25-2.00% manganese (Mn);
1.20-2.70% chromium (Cr);
0.45-1.50% tungsten (W);
not more than 0.05% molybdenum (Mo);
not more than 0.02% vanadium (V);
not more than 0.60% silicon (Si);
not more than 0.10% copper (Cu);
not more than 0.02% titanium (Ti);
not more than 0.02% niobium (Nb);
not more than 0.008% aluminum (Al); and
not more than 0.02% of any other element with not more than 0.10% total other elements, wherein cobalt (Co) is substitutable for any part of the nickel.

2. The steel of claim 1, further comprising, by weight:
not more than 0.008% sulfur;
not more than 0.015% phosphorus;
not more than 40 ppm oxygen;
not more than 4 ppm hydrogen;
not more than 0.005% antimony;
not more than 0.005% arsenic; and
not more than 0.005% tin.

3. The steel of claim 1, wherein said steel comprises a microstructure comprising tempered martensite with, or without bainite, preferred minimal amounts of S, P, As, Sb, Sn, oxygen and hydrogen impurities, and preferred shape control of any S constituents.

4. The steel of claim 1, further comprising, by weight:
0.14-0.20% nitrogen;
0.14-0.18% carbon;
1.00-1.80% nickel;
1.00-1.70% manganese;
1.30-1.70% chromium; and
0.45-0.90% tungsten.

5. The steel of claim 1, further comprising, by weight:
0.16-0.21% nitrogen;
0.16-0.20% carbon;
0.60-2.20% nickel;
0.50-2.00% manganese;
1.30-1.85% chromium; and
0.45-0.90% tungsten.

6. The steel of claim 1, further comprising, by weight:
0.18-0.22% nitrogen;
0.18-0.22% carbon;
0.60-1.70% nickel;
0.50-2.00% manganese;
1.50-1.90% chromium; and
0.45-1.30% tungsten.

7. The steel of claim 1, further comprising, by weight:
0.24-0.60% nitrogen; and
0.08-0.28% carbon;
0.10-1.00% nickel;
0.25-1.00% manganese;
1.20-2.70% chromium; and
0.45-1.50% tungsten.

8. The steel of claim 1, wherein said steel at gas pressure of 40 bar (40 MPa) or greater, upon transition through casting solidification and cooling, comprises, partially by weight:
up to 0.008% gas; and
up to 28% delta ferrite.

9. A method of making a low alloy high nitrogen steel structure, the method comprising:
providing a steel composition comprising iron and, by weight:
0.14-0.60% nitrogen (N),
0.08-0.28% carbon (C),
0.10-2.20% nickel (Ni),
0.25-2.00% manganese (Mn),
1.20-2.70% chromium (Cr),
0.45-1.50% tungsten (W),
not more than 0.05% molybdenum (Mo),
not more than 0.02% vanadium (V),
not more than 0.60% silicon (Si),
not more than 0.10% copper (Cu),
not more than 0.02% titanium (Ti),
not more than 0.02% niobium (Nb),
not more than 0.008% aluminum (Al), and
not more than 0.02% of any other element with not more than 0.10% total other elements, wherein cobalt (Co) is substitutable for any part of the nickel;
casting liquid to solid, or solid state processing under a first atmosphere, then hot working or forming said steel composition to form to a shape;
heating said steel composition to normalize or austenitize;
quenching said steel composition at a rate to produce a substantially martensitic, bainitic, or mixed martensitic bainitic microstructure; and
heating tempering said steel composition under a second gas atmosphere, wherein said second gas atmosphere comprises air, controlled atmosphere, or inert nitrogen or nitrogen and argon, or heating tempering in liquid environment.

10. The method of claim 9, wherein the heating austenitizing further comprises heating and holding said steel composition to a temperature in a range of about 890° C. to about 950° C.

11. The method of claim 9, wherein said quenching comprises at least one of:
quenching into oil held at a temperature in a range of about 38° C. to about 177° C.;
quenching into a solution of polymer and water held at a temperature in a range of about 27° C. to about 66° C.;
quenching into a controlled stream of air or inert gas;
applying a cryogenic treatment to a temperature in a range from about −78.5° C. to about −20° C.; and
quenching into media at an intermediate temperature in a range from about 460° C. to about 550° C., holding for a predetermined time to harden said steel composition, followed by secondary quenching to a lower temperature.

12. The method of claim 9, wherein said heating tempering comprises at least one of:
a single tempering step;
multiple tempering steps comprising at least one chilling between tempering steps;
multiple tempering steps without chilling between tempering steps;
a controlled rate of cooling following tempering to minimize, or eliminate, the possible occurrence of tempered martensite embrittlement;
austempering, comprising intermediate quenching to a temperature in a range from about 440° C. to about 550° C. and holding prior to said quenching; and
said quenching proceeding after a thermal mechanical treatment at a temperature in a range from about 860° C. to about 1000° C., wherein said tempering comprises at least one of a primary hardening at a temperature in a range from about 200° C. to about 440° C., or a at a temperature in a range from about 440° C. to about 650° C.

13. The method of claim 9, further comprising hot working by rolling, forging or extrusion of said steel composition at a temperature in a range from about 1000° C. to about 1190° C. to a predetermined structure shape, said hot working comprising either increments or single steps of heating and reduction.

14. The method of claim 13, further comprising performing heat treatments of a softening anneal process following said hot working, and following any softening anneal with a heat treatment comprising normalizing said steel composition at a temperature in a range from about 870° C. to about 1020° C. followed by air cooling.

15. The method of claim 14, wherein after softening annealing, said method further comprising performing at least one of mechanical cutting, machining, flame cutting, plasma cutting, grinding, and sanding a finish dimension or surface of said low alloy high nitrogen steel structure.

16. The method of claim 13, further comprising, prior to hot work, preheat and/or homogenizing said steel composition at a temperature in a heating range from about 870° C. to 1121° C.

17. The method of claim 9, further comprising performing a solid state process of alloying, either by mechanical alloying of powder materials under N gas, N plus Ar gas, or N with ammonia or either first performing under N or with a controlled atmosphere of N with ammonia to perform diffusion of N gas into solid surfaces, powders, or thin sheet materials, wherein following mechanical alloying or a gas-solid diffusion N alloyed powder or thin sheets, are manufactured and consolidated to a final structure by any combinations of cleaning, surface finishing, cold isostatic pressing, hot isostatic pressing, sintering, hot work, austenitization, quench, or temper processing at or greater than atmospheric pressure.

18. The method of claim 17, further comprising using hot isostatic pressure to obtain said final structure by packing and sealing a powder or thin sheets in a container under nitrogen gas, then performing any combination of (i) remotely pressurizing said container to provide specific N pressure and mass so as to equal the argon pressure level of the surrounding hot isostatic press and then heating said hot isostatic press to diffuse the mass of N to complete finished composition solid powder or thin sheets; (ii) performing vacuum evacuation of said container of finished composition powder or thin sheets to remove gas; and/or (iii) cold isostatic pressing to remove bulk, then fully consolidating by hot isostatic pressing (HIP) at approximately 1000 to 1500 bars and at about temperatures of 1090° C. to 1250° C., following with an optional treatment of said hot work.

19. The method of claim 17, further comprising obtaining said final structure by cold isostatic press consolidation of powder or thin sheet material of finished or near finished composition in nitrogen gas or controlled atmosphere in any of a sealed container or a shaped mold and then hot sintering or pressing at temperatures of approximately 1150° C. to 1400° C. under N or N plus Ar at pressures of approximately 120 bars up to 250 bars followed by optional consolidation and shaping by hot extrusion or hot rolling at temperatures of approximately 1070° C. to 1300° C.

20. The method of claim 17, further comprising obtaining said final structure by packing and sealing powder or thin sheet material of finished composition in a container under nitrogen gas or controlled atmosphere, evacuation to remove gas, cold isostatic pressing to remove bulk and then full consolidation by hot extrusion or hot rolling at temperatures of approximately 1070° C. to 1300° C.

* * * * *